US010706749B1

(12) United States Patent
White et al.

(10) Patent No.: US 10,706,749 B1
(45) Date of Patent: Jul. 7, 2020

(54) SHELF LABEL HOLDER WITH BREAKAWAY GUIDE AND METHOD

(71) Applicant: K-International, Inc., Waukegan, IL (US)

(72) Inventors: Paul Gregory White, Lake Forest, IL (US); Michael L. Sisko, Ripon, WI (US); Michael J. White, Ripon, WI (US)

(73) Assignee: K-International, Inc., Waukegan, IL (US)

( * ) Notice: Subject to any disclaimer, the term of this patent is extended or adjusted under 35 U.S.C. 154(b) by 0 days.

(21) Appl. No.: 16/536,596

(22) Filed: Aug. 9, 2019

(51) Int. Cl.
*G09F 3/20* (2006.01)

(52) U.S. Cl.
CPC ..... *G09F 3/204* (2013.01); *G09F 3/208* (2013.01)

(58) Field of Classification Search
CPC ..... G09F 3/208
See application file for complete search history.

(56) References Cited

U.S. PATENT DOCUMENTS 4,557,064 A * 12/1985 Thompson ..... G09F 3/204 40/361
5,611,512 A * 3/1997 Cholet ..... G09F 3/20 248/220.22
6,035,569 A 3/2000 Nagel et al.
6,082,687 A * 7/2000 Kump ..... A47F 5/0068 211/57.1
6,119,990 A 9/2000 Kump et al.
6,553,702 B1 4/2003 Bacnik
6,571,498 B1 * 6/2003 Cyrluk ..... G09F 3/204 108/27
6,935,062 B2 8/2005 Lowry et al.
7,455,081 B2 11/2008 Bacnik
2004/0178308 A1 * 9/2004 Bacnik ..... G09F 3/204 248/223.41
2005/0016039 A1 * 1/2005 Abramson ..... G09F 3/204 40/611.01
2005/0188574 A1 * 9/2005 Lowry ..... G09F 3/204 40/651
2012/0110883 A1 * 5/2012 White ..... G09F 7/18 40/606.01
2012/0144706 A1 * 6/2012 Engelby ..... G09F 3/204 40/584

* cited by examiner

*Primary Examiner* — Kristina N Junge
(74) *Attorney, Agent, or Firm* — Schiff Hardin LLP

(57) ABSTRACT

A holder for electronic shelf labels includes a channel having upper and lower ledges with upper and lower gripping flanges defining an engagement space into which a back of the electronic shelf label is mounted. A fin extends from a backplane of the channel, the fin having one side perpendicular to the backplane. The front of the upper and lower gripping flanges have inwardly-directed bevels. A breakaway guide is connected by a thinned portion to the backplane to engaging an edge of a mounting structure. The breakaway guide is removable following mounting of the channel.

33 Claims, 12 Drawing Sheets

SHELF LABEL HOLDER WITH BREAKAWAY GUIDE AND METHOD

BACKGROUND OF THE INVENTION

Field of the Invention

The present invention relates generally to a label holder and more particularly to a label holder for mounting on a shelf, such as a store shelf, and to a method for mounting the shelf label holder.

Description of the Related Art

Retail stores use shelf labels to display price information and other information about products being sold by the store. Store shelves are provided in a variety of configurations depending on the products sold, the type of store, layout of the store, and other factors. Shelf labels are mounted to the shelves by various mounting techniques. Each time a store wishes to change the shelf label such as to change products or change the price of the product, a store employee or other worker must remove the old label and mount a new label at each product location. Significant labor costs are involved in changing shelf labels.

Electronic shelf labels (ESL) are being used in some retail stores. The electronic shelf label includes an electronic module with a display screen on which is displayed price and product information. The electronic module has a battery with a long battery life, for example of eight to ten years, for some electronic shelf labels. Each electronic shelf label module is wirelessly addressable to change displayed product information including changing product price information displayed on the electronic shelf label. Mounting the electronic shelf label modules to store shelves and other store locations has presented challenges as store change from paper price labels to electronic shelf labels.

Home stores, warehouse stores and so-called big box stores may provide products on warehouse shelving, pallet racks, or other such shelving systems which lack C-channels for holding price tags as are more common with grocery store shelves, drug stores, and other retail stores. The warehouse shelving or pallet racks may include horizontal members formed of rectangular steel beams or tubes. Price and product information is typically provided as a paper sticker adhered to the front surface of the steel beam. An electronic shelf label provided on such steel been should be mounted in a position such as not to be dislodged as products are removed or restocked on the shelves, nor when bumped by shopping carts, hand trucks, dollies, platform trucks, panel carts, or by customers themselves.

SUMMARY OF THE INVENTION

The present invention provides an apparatus and method for fastening shelf labels to a shelf. In certain embodiments, an apparatus and method for holding electronic shelf labels is provided. In certain embodiments, the method and apparatus aligns and positions the shelf label holder relative to an edge of the shelf while mounting the holder to the shelf. In certain embodiments, the shelf label holder securely affixes one or more electronic shelf labels in position on a shelf.

Figure 17:
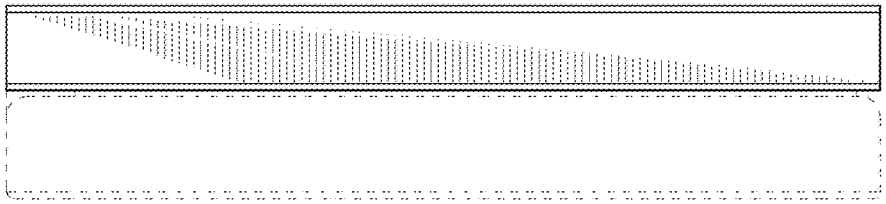
Figure 16:
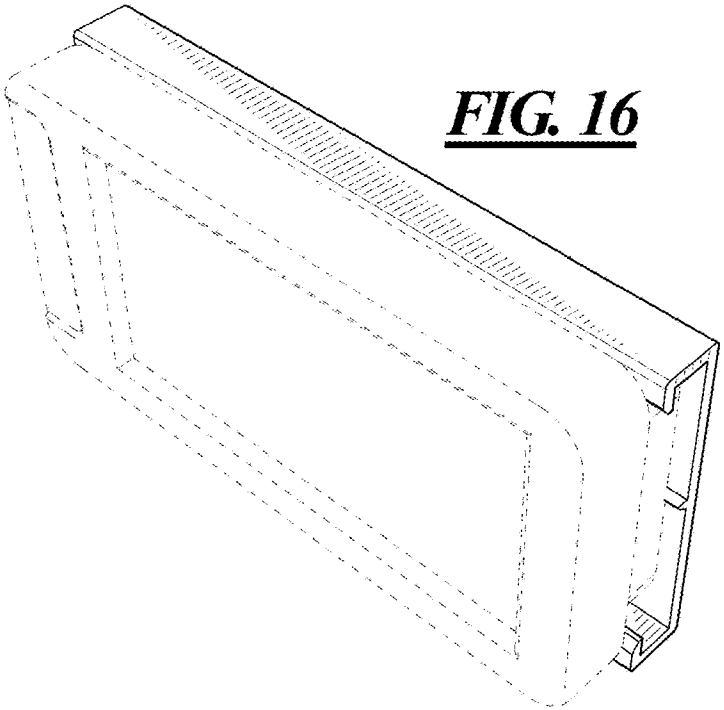
Figure 18:
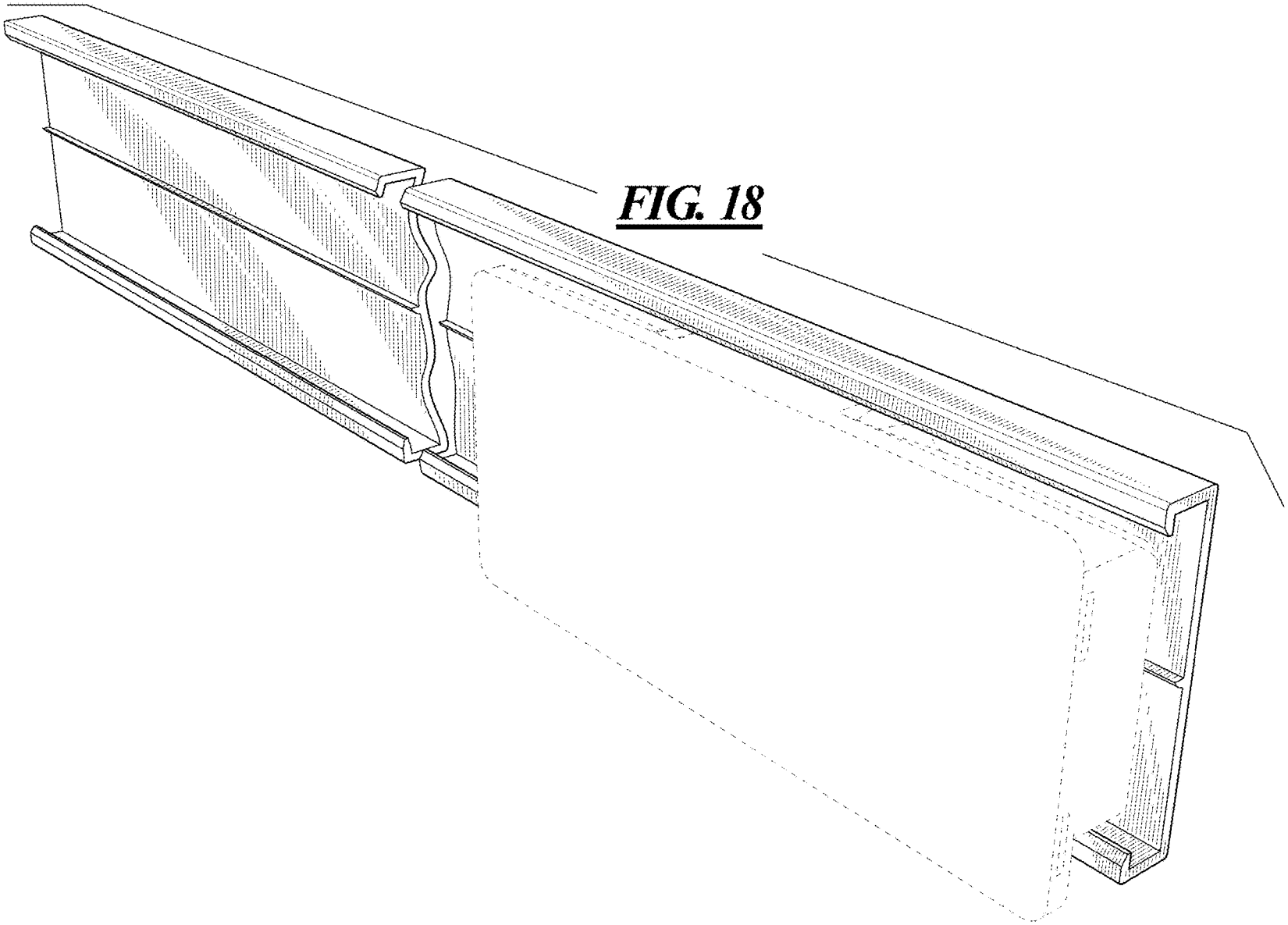
Figure 19:
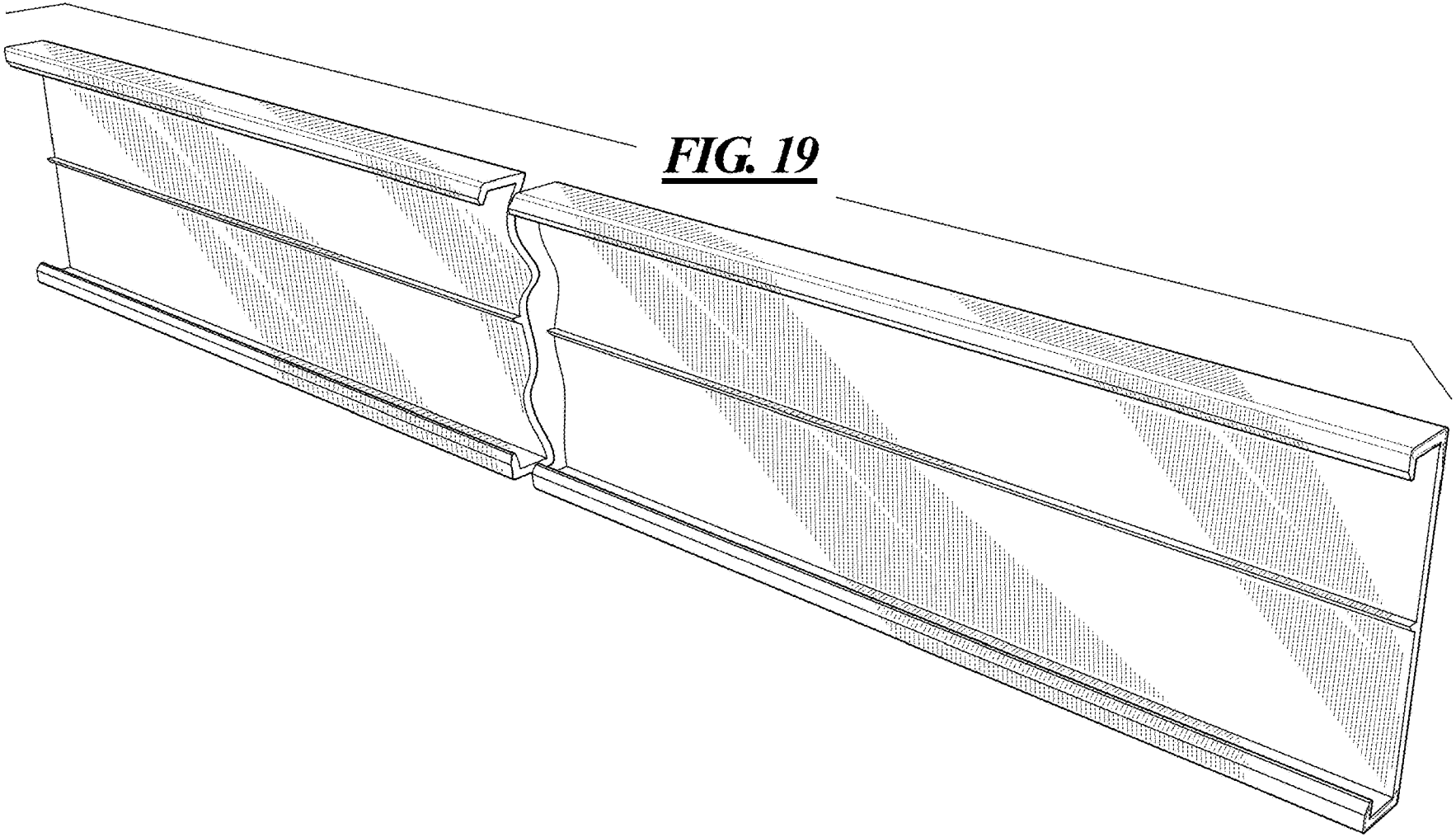
Figure 22:
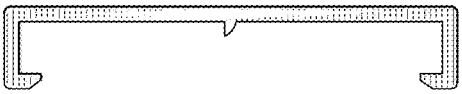
Figure 23:
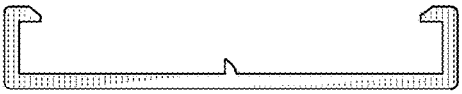
Figure 20:
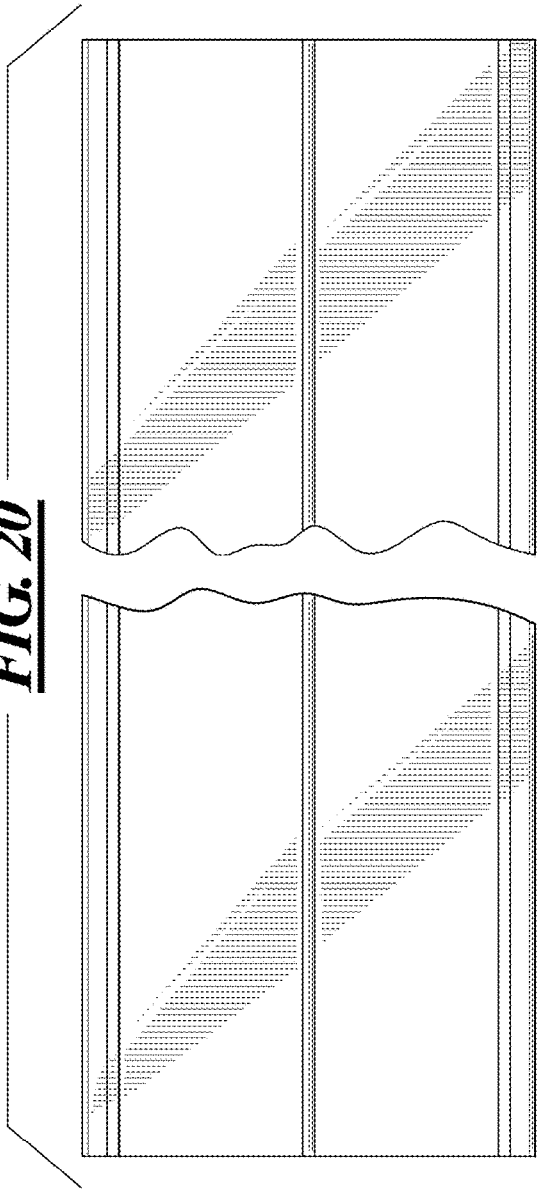
Figure 21:
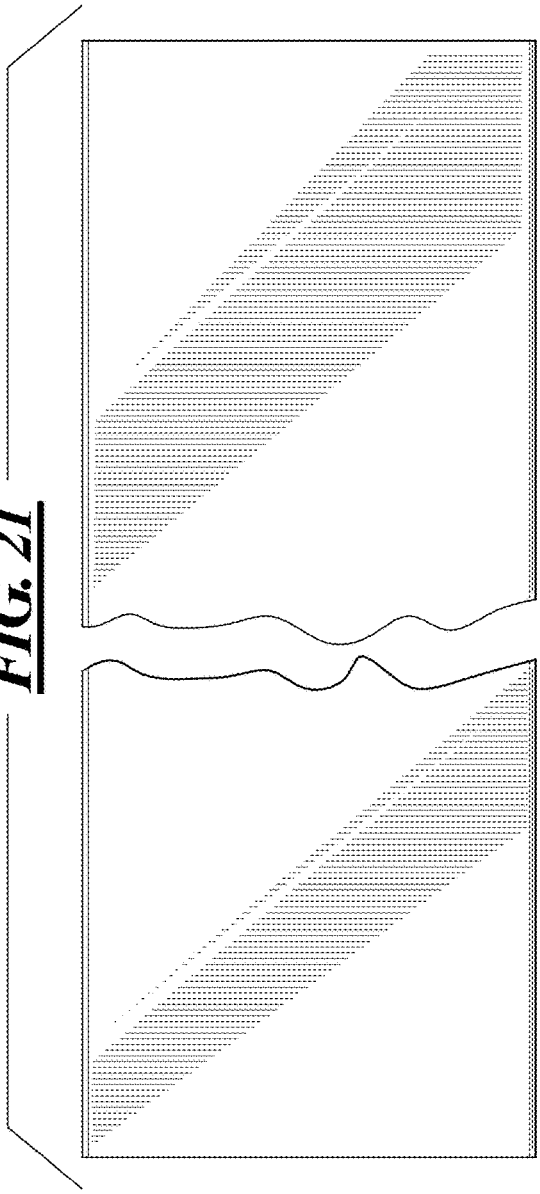
Figure 24:
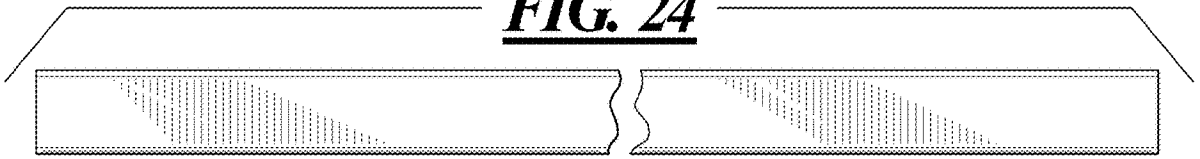
Figure 25:
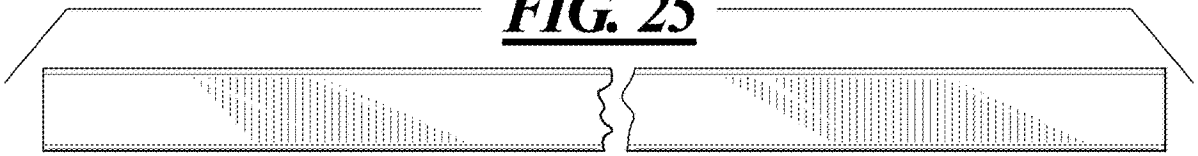
Figure 27:
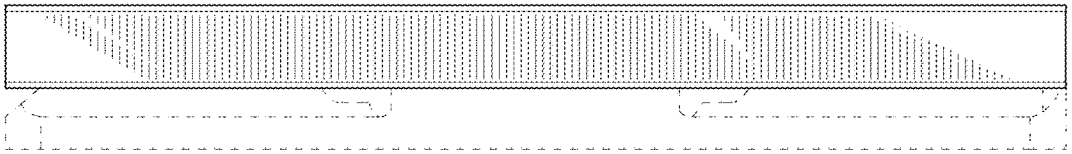
Figure 26:
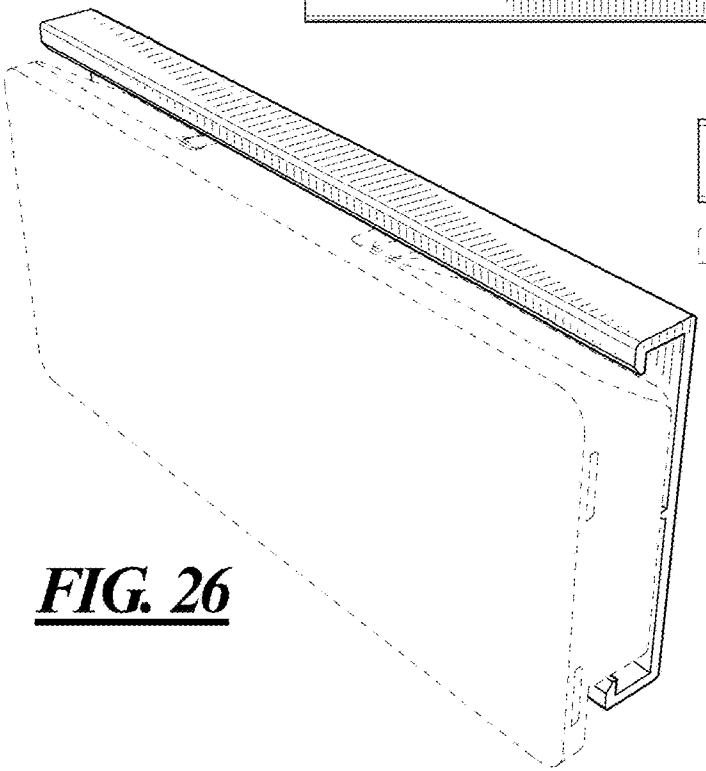

An Appendix includes FIGS. 8-17 showing a first embodiment of an elongated channel for holding a first electronic shelf label, FIGS. 8-15 showing a longer version and FIGS. 16 and 17 showing a shorter version of the same structure which is identical to FIGS. 8-15 in all aspects except length, and FIGS. 18-27 showing a second embodiment of an elongated channel for holding a second electronic shelf label, FIGS. 18-25 showing a longer version and FIGS. 26 and 27 showing a shorter version of the same structure which is identical to FIGS. 18-25 in all aspects except length.

DETAILED DESCRIPTION OF THE PREFERRED EMBODIMENTS

Figure 1:
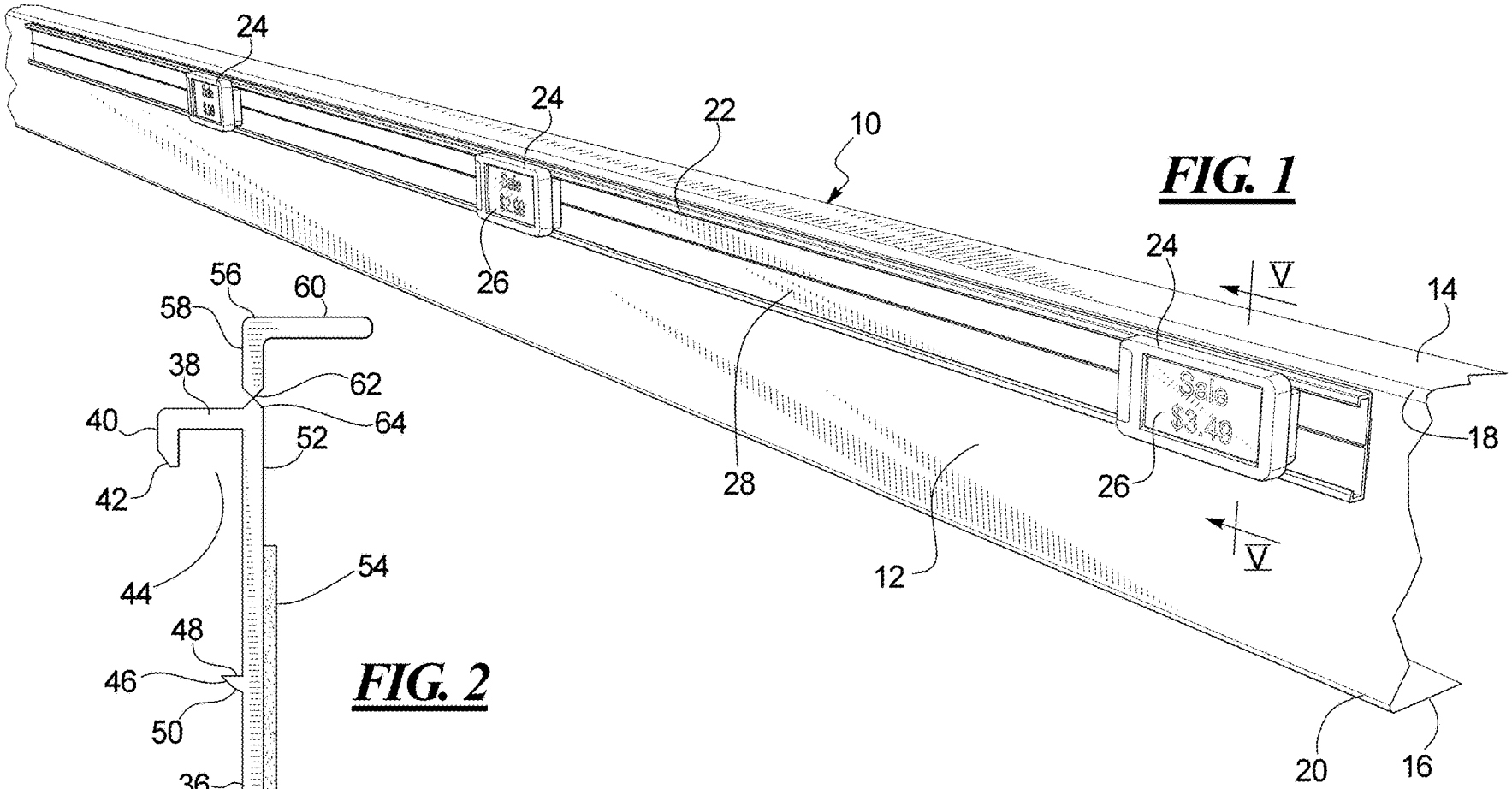
FIG. 1 is a front, top, right side perspective view of a horizontal beam of a store shelf on which is provided a shelf label holder holding electronic shelf labels.

Referring first to FIG. 1, a horizontal beam 10, which may be a beam of a shelf unit in a warehouse store, hardware store, big box store, or other facility, has a front facing surface 12, a top surface 14, and a bottom surface 16. The front facing surface 12 joins the top surface 14 at an upper radius or bevel 18. Similarly, the front facing surface 12 joins the bottom surface 16 at a lower radius or bevel 20. The horizontal beam 10 may be the front edge of a shelf on which is provided merchandise that a customer seeks to remove from the shelf for purchase. The beam 10 may be positioned above a lower shelf that contains merchandise that the customer also wishes to remove for purchase. The merchandise may be any type of merchandise including merchandise that is large and/or unwieldy, such as construction materials, ladders, appliances, or other items. Price and product information should be provided at a location on the shelf beam 10 where it is visible to the customer and where it is protected from being bumped as merchandise is removed from both the upper and lower shelves.

Although named here as a horizontal beam 10, the beam may be a vertical beam, and angled beam or other position. The front facing surface 12 may be a top surface, bottom surface, inside surface or other surface as desired. The horizontal beam 10 may instead be a shelf surface, or other surface of a fixture, structure or other surface.

A shelf label holder 22 is mounted on the front facing surface 12 of the horizontal beam 10. The shelf label holder 22 is shown holding three electronic shelf labels 24. The electronic shelf labels 24 include a display screen 26 on which is shown price information, product information, sale information, or other information as desired. The electronic shelf labels units 24 include wireless communication circuits that receive commands from a central location, such as from a store office, to update the displayed information. Each electronic shelf label 24 is individually addressable. For example, if a product is on sale at a discounted price for a particular time period, a command may be sent from the store office to the corresponding price label unit 24 to change the displayed price so that the display screen 26 shows the discounted price for the time period of the sale. A command may be sent following the sale time period to display the prior price, or another price, on the display screen 26. Other changes in displayed information are also possible.

The shelf label holder 22 includes an elongated channel 28 into which the electronic shelf labels 24 are mounted. The elongated channel 28 may extend along the entire length of the horizontal beam 10 or along a portion of the horizontal beam 10. For example, in some stores, the horizontal beam 10 for a shelf unit extends for as long as sixteen feet or more. The elongated channel 28 may extend along the full sixteen feet length of the horizontal beam 10. Shorter lengths of the elongated channel 28 may be provided on the front facing surface 12 of the horizontal beam 10. For example, one or more sections of the elongated channel 28 may be provided at positions spaced horizontally from one another along the horizontal beam 10. It is also foreseen that a second elongated channel may be provided on the front facing surface 12 below the first elongated channel 28. The upper elongated channel 28 may contain electronic shelf labels 24 for products located on the shelf above the horizontal beam 10 and the lower elongated channel 28 may contain electronic shelf labels 24 for products located on the shelf below the horizontal beam 10. The elongated channel 28 may instead be mounted lower on the beam 10, for example where products are only located on the self below the beam 10.

In certain installations of the elongated channel 28, a short section of the elongated channel 28 having a length to hold one electronic shelf label 24 is provided. The short section of the elongated channel 28 may be of a length less than the length of the electronic shelf label 24, equal to the electronic shelf label 24, greater than the electronic shelf label 24, or several times the length of the electronic shelf label 24. The elongated channel 28 is formed by extrusion. The extrusion may be cut to any desired length. The elongated channel 28 may be provided either with or without a breakaway guide.

The electronic shelf labels 24 may be attached into the elongated channel 28 anywhere along the elongated channel 28. For example, the electronic shelf labels are mounted below each product on the upper shelf and/or above each product on the lower shelf that is disposed below the horizontal beam 10. The display 26 may indicate, such as by an arrow, if the price and information relates to the product above the electronic shelf label 24 or below it.

The shelf label holder 22 is positioned so that it extends in a direction parallel to the top surface 14 of the horizontal beam 10. In the illustration, the shelf label holder 22 is also parallel to the bottom surface 16 of the horizontal beam 10. For installations where the top and bottom surfaces 14 and 16 of the horizontal beam 10 are not parallel to one another, the shelf label holder 22 may be installed parallel to either the top or the bottom surface 14 or 16.

The shelf label holder 22 is positioned at a predetermined spacing from the top surface 14. The predetermined spacing of the shelf label holder 22 from the top surface 14 may be provided for each installation of the shelf label holder 22 on each horizontal beam 10, including for further sections of the shelf label holder 22 installed on the same horizontal beam 10 and for sections of the shelf label holder 22 installed on other horizontal beams 10. The shelf label holder 22 is mounted so that it neither slopes either upwardly or downwardly along its length relative to the horizontal beam 10 nor does it curve up or down, wiggle, twist, or otherwise depart from a linear position parallel to the top edge, or have other irregularities in its path on the horizontal beam 10. A slope, curve, wiggle or other departure from a linear, parallel position of the shelf label holder 22 on the horizontal beam 10 would be apparent to a customer looking down the aisle of products. A departure from a uniform spacing of the shelf label holder 22 from the top edge of the horizontal beam 10 will be apparent to customers looking down the aisle where multiple elongated channels 28 are used along the horizontal beam 10 or along multiple horizontal beams 10 that run along the store aisle.

Figure 2:
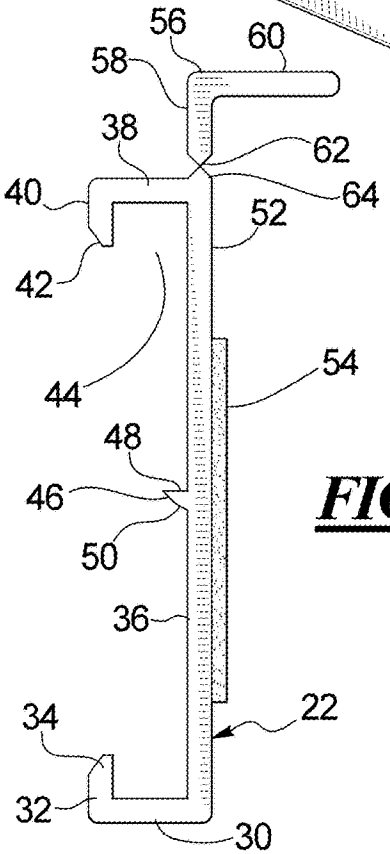
FIG. 2 is an end view of the shelf label holder with an attached breakaway guide.

Referring to FIG. 2, a shelf label holder 22 is shown in an end view. At a lower end is a lower ledge 30 having an upwardly extending lower gripping flange 32 at its free end. The lower gripping flange 32 includes an angled bevel 34 at a forward or outward corner. The lower ledge 30 is connected to a backplane 36 that extends to an upper ledge 38. The upper ledge 38 extends forwardly from the backplane 36 in the same direction as the lower ledge 30 and has a downwardly extending upper gripping flange 40 at its free end. The upper gripping flange 40 extends downwardly and has an angled bevel 42 at its free end at the forward or outward corner. The angled bevels 34 and 42 are directed toward one another and provide inwardly angled surfaces against which an electronic shelf label 24 may be pressed when the electronic shelf label 24 is being mounted into the shelf label holder 22. Together, the lower gripping flange 32, the lower ledge 30, the backplane 36, the upper flange 38 and the upper gripping flange 40 form an engagement space 44 into which a portion of the electronic shelf label 24 may be secured.

Extending forwardly from the backplane 36 into the engagement space 44 and extending in the same direction as the upper and lower ledges 38 and 30 is a resilient fin 46. The resilient fin 46 of the illustrated embodiment is located midway between the upper and lower ledges 30 and 38. Other positions for the resilient fin 46 are also possible. The resilient fin 46 is formed of a flexible, pliable, resilient, high-friction material, such as polypropylene, that is affixed to the backplane 36. In certain embodiments, the shelf label holder 22 is formed by extrusion of a relatively ridged plastic material for the body of the elongated channel 28 and the resilient fin 46 of resilient material is co-extruded with the elongated channel 28. The shelf label holder 22 is uniform in shape along its length so as to permit the electronic shelf label units 24 to be mounted at any position along the shelf label holder 22. It is envisioned that the resilient fin 46 may be discontinuous. For example, the resilient fin 46 may include a series of short or long segments. The resilient fin 46 may be located either in the middle as shown, or closer to the top or bottom of the elongated channel 28. Multiple resilient fins 46 may be provided, for example, in parallel with one another, in certain embodiments.

The resilient fin 46 is triangular in cross section, having a wider base attached to the backplane 36 and angling to a thin outer edge away from the backplane 36. In the illustrated embodiment, the resilient fin 46 has a top surface 48 at a right angle to the backplane 36 and a bottom surface 50 at an acute angle to the backplane 36. The angled bottom surface 50 may be planar or may be curved between the base and the thin outer edge. For example, the bottom surface 50 may be a continuous curve, or series of segments of flat surfaces that are along a curved line.

The height of the resilient fin 46 from the backplane 36 of the illustrated embodiment is approximately 30 percent of the distance between the backplane 36 and the inside of the upper or lower gripping flanges 40 and 32. The resilient fin 46 may extend up to 50 or more of the gripping flange distance or may be as little as 10 percent or less. Other percentages are possible. The resilient fin 46 provides a high friction surface against which the electronic shelf label 24 presses. Sliding of the electronic shelf label 24 along the elongated channel 28 is prevented by the friction. The triangular shape of the resilient fin 46, which may be referred to as a shark fin shape, provides increasing pressure on the back of the electronic shelf label 24 the further the electronic shelf label is pressed into the engagement space 44.

The backplane 36 has a planar back surface 52 on which is provided an adhesive 54. The adhesive 54 may be any type of adhesive, such as glue, tape, foam tape, or other adhesive. One or more fasteners, such as screws, bolts, rivets, nails, magnets, hook-and-loop fasteners, or other types of fasteners may be provided instead of or in addition to the adhesive. For examples, screws may be inserted through the label holder 22 and into the surface to which the label holder is mounted, for instance, at multiple locations along the length of the label holder. In certain embodiments, the adhesive 54 is foam tape that has been adhesively applied to the back surface 52 and that has a peel-off cover over an adhesive surface on the opposite surface of the foam tape. Foam tape 54 may accommodate variations in the surface of the horizontal beam 10. The shelf label holder 22 is mounted to the horizontal beam 10 by pealing the cover from the foam tape 54 and pressing the shelf label holder 22 onto the front facing surface 12 of the beam 10.

At an upper end of the elongated channel 28 is a breakaway guide 56. The breakaway guide 56 includes an L-shaped member extending from the top of the elongated channel 28. A first portion 58 of the breakaway guide 56 is co-planar with the backplane 36 and a second portion 60 extends in a direction opposite the upper and lower ledges 38 and 30. The first and second portions 58 and 60 are at a right angle to one another. The second portion 60 may have a length greater than radius or bevel 18 between the front facing surface 12 and the top surface 14 of the horizontal beam 10. In certain embodiments, the length of the second portion 60 also includes a distance equal to the thickness of the adhesive 54 in addition to the length greater than the radius or bevel 18.

A constriction or thinned portion 62 connects the elongated channel 28 to the breakaway guide 56. The thinned portion 62 in the illustrated embodiment includes a triangular portion 64 on the top end of the elongated channel 28 and a triangular end on the first portion 58. The peaks of the triangular shapes 64 and on 58 are joined by a thin web or membrane. The thinned portion 62 may include perforations instead of or in place of the thin web or membrane, or of another structure permitting the breakaway guide 56 to be removed from the elongated channel 28 at the thinned portion 62.

Figure 3:
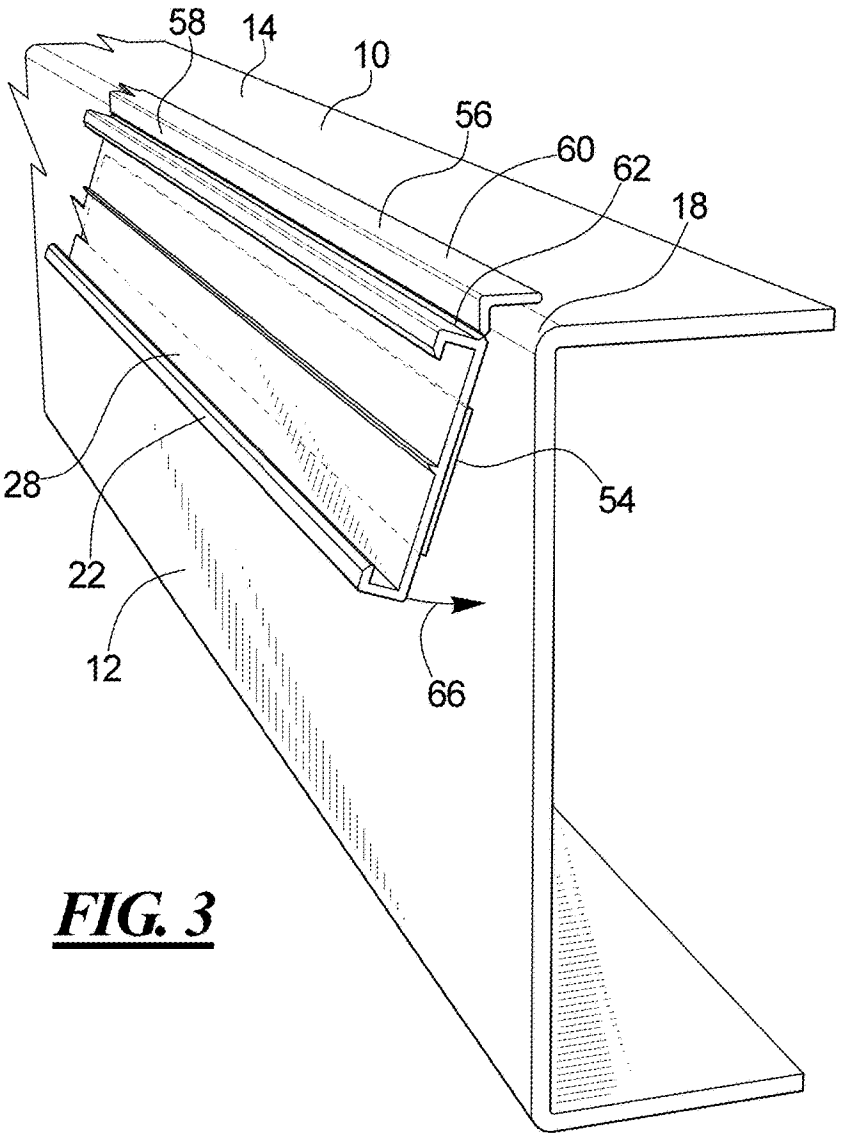
FIG. 3 is an end perspective view of a shelf beam to which the shelf label holder is being applied.

Turning to FIG. 3, the shelf label holder 22 is being mounted on the horizontal beam 10. The breakaway guide 56 is positioned along the edge of the horizontal beam 10 with the second portion 60 on the top surface 14 and the L-shaped breakaway guide extending over the upper radius or bevel 18 and the first portion 58 against or parallel to the front facing surface 12 of the horizontal beam 10. The elongated channel 28 of the shelf label holder 22 may be flexed relative to the breakaway guide 56 while the breakaway guide 56 remains in position on the beam 10, as shown.

Two possible mounting processes will be described. In a first mounting process, the breakaway guide 56 is positioned as shown. The elongated channel 28 is pivoted away from the front facing surface 12 and the covering over the adhesive 54 is removed at one end of the shelf label holder 22. While the breakaway guide 56 is maintained in position, the covering over the adhesive 54 is pulled off and the exposed adhesive is pressed against the front facing surface 12 in the direction of the arrow 66. The process of pulling the cover from the adhesive 54 and pressing the adhesive 54 onto the surface 12 while maintaining the breakaway guide 56 in position continues along the length of the shelf label holder 22. A single worker may mount the shelf label holder 22 onto the horizontal beam 10 along the full length of the beam 10 while ensuring that the shelf label holder 22 is even, parallel, and uniformly spaced from the top surface 14. Or two people may perform the process, one to maintain the position of the breakaway guide 56 and the second to pull the cover from the adhesive 54 and press the adhesive against the surface 12.

A second possible process for mounting the shelf label holder 22 may include first removing the cover from the adhesive 54 along the full length of the shelf label holder 22. Next, the breakaway guide 56 is positioned on the top surface 14 along the upper radius or bevel 18, while keeping the adhesive 54 on the elongated channel 28 away from the front facing surface 12, such as by pivoting at the thinned portion 62. Once the breakaway guide 56 is in position, the elongated channel 28 is pivoted in the direction of the arrow 66 to adhere the adhesive 54 to the front facing surface 12. The second process may work better for short lengths of shelf label holder 22 or for mounting by two people, while the first process may work better for longer lengths of the shelf label holder 22 or for mounting by one person. Other techniques for mounting the shelf label holder 22 may be apparent to those of skill in the art and are encompassed within this specification.

Figure 4:
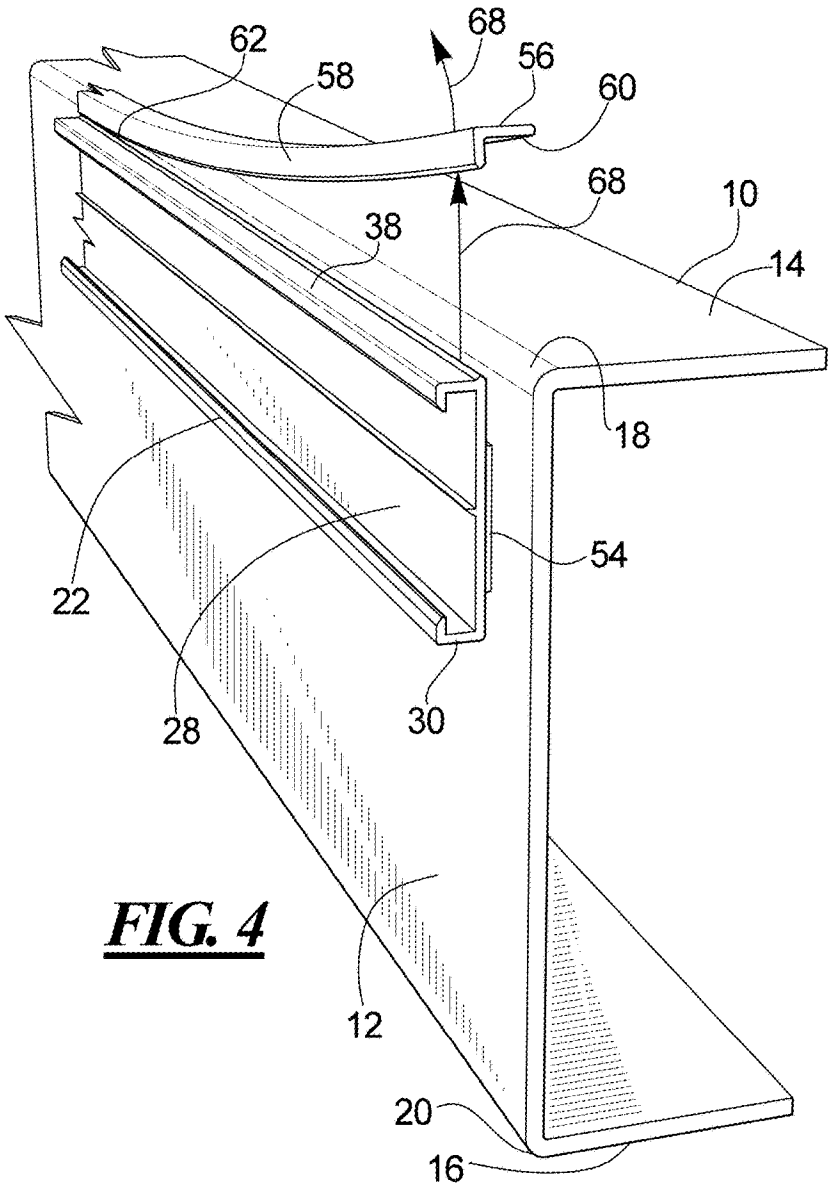
FIG. 4 is an end perspective view of the shelf label holder affixed to the shelf beam and the breakaway guide being removed.

With reference to FIG. 4, the shelf label holder 22 has been affixed to the horizontal beam 10, for example, by the process shown in FIG. 3. The breakaway guide 56 is removed from the elongated channel 28. In the illustrated example, the thinned portion 62 may be torn by pulling the breakaway guide 56 up and away from the elongated channel 28 in the direction of the arrows 68. The tearing may start at one end of the shelf label holder 22 and continue pulling in the direction 68 along the length of the shelf label holder 22 until the breakaway guide 56 has been completely removed from the elongated channel 28. Removal of the breakaway guide 56 from the elongated channel 28 leaves the elongated channel 28 mounted on the horizontal beam 10 at a uniform spacing from the top surface 14 and in a position parallel to the top surface 14. The elongated channel 28 is mounted without sloping up or down, or wavering up and down, or otherwise at an uneven orientation or spacing on the beam 10.

As is apparent from FIG. 4, the upper ledge 38 of the elongated channel 28 is below the upper radius or bevel 18 of the horizontal beam 10. If desired, the elongated channel 28 may be mounted lower on the front facing surface 12 by providing a breakaway guide 56 that has a longer first portion 58. The breakaway guide 56 may be sized as needed for the horizontal beam 10 or other surface to which the shelf label holder 22 is mounted. For example, the breakaway guide 56 may have larger or smaller first and second portions 58 and 60, or may have a curved or other shape instead of the right angle shape of the illustrated embodiment. In certain examples, the breakaway guide 56 is sized to position the elongated channel 28 midway between the top and bottom surfaces 14 and 16.

As will be understood by those of skill in this art, the breakaway guide 56 may be positioned on the bottom surface 16 and along the lower radius or bevel 20 to position the shelf label holder 22 along the lower portion of the front facing surface 12. The elongated channel 28 will still be aligned uniformly on the horizontal beam 10 and parallel to the top and bottom surfaces 14 and 16. It is contemplated to provide two breakaway guides 56, one extending from the upper ledge 38 and the other extending from the lower ledge 30. The two breakaway guides may be positioned on respective top and bottom surfaces 12 and 14 of a beam 10 to position the elongated channel 28 in a position on the beam 10. Both breakaway strips may be removed following attachment of the elongated channel 28.

The shelf label holder 22 may be formed of colored plastic. For example, the shelf label holder 22 may be formed in a color matching the color of the horizontal beam 10 onto which the shelf label holder 22 is fastened. The shelf label holder 22 may be formed in a color that is used as a trademark or trade dress by the store in which the shelf label holder 22 is used. The shelf label holder 22 may instead be formed of a transparent or translucent material or of a material having a neutral color. As a reminder to persons installing the shelf label holders 22, the breakaway guide 56 may be formed of a different color than the color of the elongated channel 28. For example, the elongated channel 28 may be formed of a color matching the color of the horizontal beam 10 onto which the shelf label holder 22 is mounted, while the breakaway guide 56 may be formed of a contrasting color. The installer is reminded to remove the breakaway guide 56 from the elongated channel 28 after installation of the shelf label holder 22 on the horizontal beam 10 by the contrasting color of the breakaway guide 56. Instructions to remove the breakaway guide 56 after installation may be printed on the breakaway guide 56 or otherwise indicated such as by indicia, marks, words, symbols, or the like.

The breakaway guide 56 is of a thick and strong configuration so that the breakaway guide 56 may be gripped by a user as the breakaway guide 56 is being pulled in the direction of the arrows 66 and to remain intact during tearing of the breakaway guide 56 from the elongated channel 28. The breakaway guide 56 may be provided with a grip enhancing texture to aid the user in maintaining a grip on the breakaway guide 56 during removal from the elongated channel 28.

Figure 5:
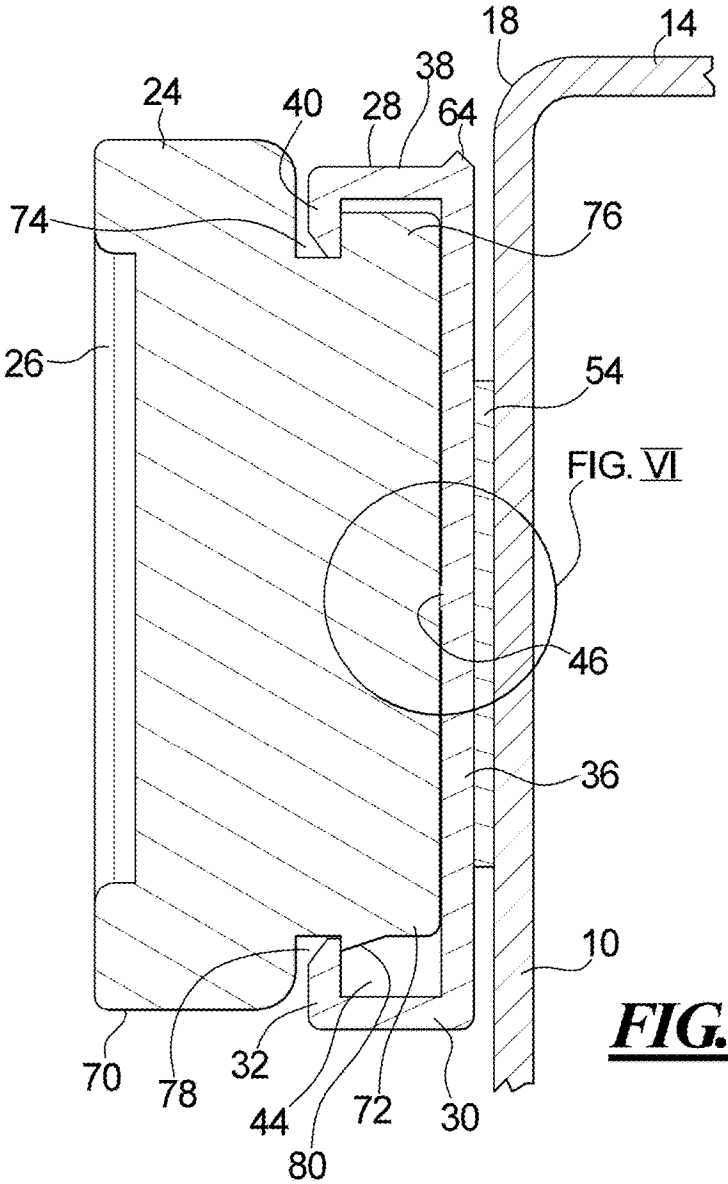
FIG. 5 is a cross-sectional view of the electronic shelf label mounted in the shelf label holder and affixed to the horizontal shelf beam, taken along line V-V of FIG. 1.

Turning to FIG. 5, an enlarged cross-sectional view along line V-V of FIG. 1 shows the electronic shelf label 24 mounted in the elongated channel 28. For the sake of simplicity, the electronic shelf label 24 is shown as a solid object, while in reality an electronic shelf label unit 24 has display components, electronic components, one or more circuit boards, an antenna, a battery and other features as desired. The illustrated electronic shelf label 24 has a display screen 26 in a front portion 70 that extends out of the elongated channel 28. A rear portion 72 of the electronic shelf label 24 fits into the engagement space 44 of the elongated channel 28. The engagement space 44, including the lower ledge 30, lower gripping flange 32, upper ledge 38 and upper gripping flange 40 are shaped and sized to fit onto the rear portion 72 of the electronic shelf label 24. The engagement space 44 of other embodiments of the elongated channel 28 may be reconfigured to other sizes, shapes, and proportions to fit onto other embodiments and models of electronic shelf labels as desired.

The rear portion 72 of the electronic shelf label 24 has an upper channel 74 and an upper rectangular projection 76. The upper gripping flange 40 extends into the upper channel 74 and the upper rectangular projection 76 fits into the space defined by the upper gripping flange 40, the upper ledge 38, and the backplane 36. The rear portion of the electronic shelf label 24 also has a lower channel 78 and a lower angled catch projection 80. The lower gripping flange 32 fits into the lower channel 78 and the lower angled catch projection 80 fits into the space defined by the lower gripping flange 32, the lower ledge 30, and the backplane 36. The lower angled catch projection 80 extends above the bottom of the lower channel 78 by a distance that is less than the distance that the upper rectangular projection 76 extends from the bottom of the upper channel 74.

The electronic shelf label 24 may be installed in the elongated channel 28 by inserting the upper rectangular projection 76 into the space defined by the upper gripping flange 40, the upper ledge 38, and the backplane 36 while the electronic shelf label 24 is tilted at an angle. The electronic shelf label 24 is then pivoted to press the lower angled catch projection 80 into the space defined by the lower gripping flange 32, the lower ledge 30, and the backplane 36. As the lower angled catch projection 80 moves past the lower gripping flange 32, the electronic shelf label snaps into an engaged position. The angled bevel 34 on the lower gripping flange 32 may engage the back lower corner of the rear portion 72 and the lower angled catch projection 80 during installation, facilitating installation. The elongated channel 28 and the electronic shelf label 24 are formed from rigid materials such that the electronic shelf label 24 resists removal from the elongated channel 28, even when the force is exerted to remove the electronic shelf label 24 from the elongated channel 28.

The lower gripping flange 32 and the lower ledge 30 of the illustrated embodiment is symmetrical to the upper gripping flange 40 and upper ledge 38 so that the electronic shelf label 24 may be inserted upside down relative to the elongated channel 28. For example, if the elongated channel 28 is mounted upside down on the horizontal beam 10, such as by aligning the breakaway guide 56 on the bottom surface 16, the electronic shelf label 24 may be installed right-side-up in the upside-down elongated channel 28. Sufficient room is provided in the engagement space 44 for either orientation of the electronic shelf label 24. Either the upper or lower gripping flanges 32 and 40 engage the lower angled catch projection 80 to hold the electronic shelf label 24 securely in the elongated channel 28.

The breakaway guide 56 has been used to install the elongated channel 28 onto the horizontal beam 10. As a result, the top of the elongated channel 28 and the top of the electronic shelf label 24 are both below the plane of the top surface 14 of the horizontal beam 10. The positioning of the elongated channel 28 as a result of the breakaway guide 56 avoids the electronic shelf label 24 being bumped and possibly dislodged during removal of merchandise from the shelf above the horizontal beam 10. In the illustrated embodiment, the top of the front portion 70 of the electronic shelf label 24 extends above the top of the upper ledge 38. The breakaway guide 56 is sized to accommodate the height of the top of the front portion 70. A different shape of the electronic shelf label 24 may require a different size breakaway guide 56 to avoid the top of the electronic shelf label 24 projecting above the product shelf.

The triangular portion 64 that remained on the upper ledge 38 after removal of the breakaway guide 56 is visible in FIG. 5.

During installation of the electronic shelf label 24 into the elongated channel 28, the back surface of the electronic shelf label 24 contacts and presses against the resilient fin 46. As the electronic shelf label 24 is pressed into an engaged position in the elongate channel 28, the resilient fin 46 is compressed. The resilient fin 46 exerts a resistant force on the electronic shelf label 24 as a result of the compression. The resistant force increases as the triangular-shaped resilient fin 46 is compressed further against the backplane 36. The resistant force by the resilient fin 46 presses the electronic shelf label 24 against the upper and lower gripping flanges 40 and 32. The resistant force by the resilient fin 46 prevents the electronic shelf label 24 from being loose in the elongated channel 28. The electronic shelf label 24 is held securely and tightly in the elongated channel 28.

The resilient fin 46 is a high friction material that engages the back surface of the electronic shelf label 24 to prevent the electronic shelf label 24 from being moved along the elongated channel 28. The resilient fin 46 ensures that the electronic shelf label 24 that has been positioned near one product cannot be moved inadvertently to another position near a different product.

By comparing FIGS. 2 and 5, the shark-fin-shaped resilient fin 46 has the right angle top surface 48 facing the upper ledge 38 where the upper rectangular projection 76 is engaged during the mounting process. The angled bottom surface 50 of the resilient fin 46 may somewhat follow the arcuate movement of the electronic shelf label 24 as the electronic shelf label 24 is pivoted into place with the lower angled catch projection 80 being engaged by the lower gripping flange 32. As the lower angled catch projection 80 engages the lower gripping flange 32 and moves upward and over the electronic shelf label 24, the non-symmetrical shape of the resilient fin 46 permits the resilient fin 46 to flex toward the right angled top surface 48. The entry of the electronic shelf label 24 is eased by the shape of the resilient fin 46. Embodiments where the electronic shelf label 24 is to be inserted upside down relative to the illustration of FIGS. 2 and 5, may invert the shark-fin-shaped resilient fin 46 to facilitate mounting of the electronic shelf label 24 in the inverted position.

FIG. 5 shows the resilient fin 46 in a compressed state between the back of the electronic shelf label 24 and the backplane 36. The compressed resilient fin 46 accommodates differences in tolerances in commercial embodiments of the electronic shelf label 24 and in the elongated channel 28. As resilient fin 46 is compressed, the pressing force is borne by the backplane 36, which in turn is borne by the adhesive 54 and the horizontal beam 10. The electronic shelf label 24 may be more readily mounted into the elongated channel 28 when the elongated channel 28 is mounted on a rigid structure, such as a steel horizontal beam 10.

Figure 6:
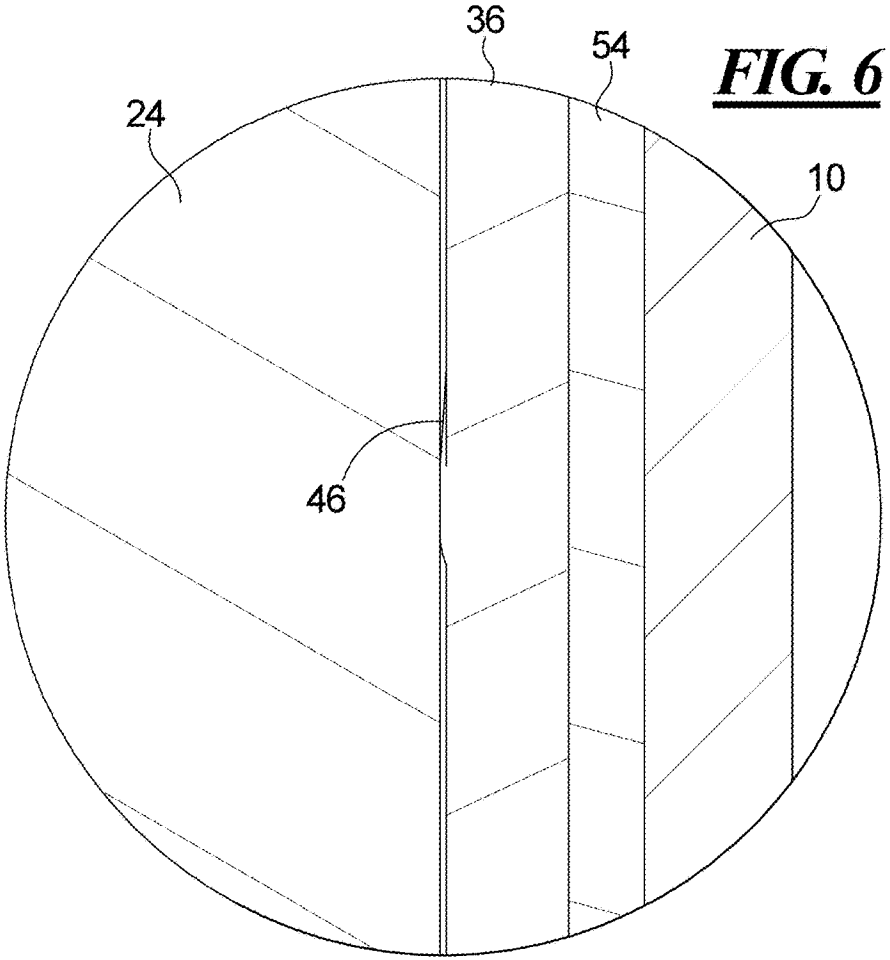
FIG. 6 is an enlarged view of a compressed rib between the electronic shelf label and the shelf label holder.

FIG. 6 shows an enlarged view of the area VI in FIG. 5. The layers in order from left to right are the electronic shelf label 24, a slight gap in which the compressed resilient fin 46 is located, the backplane 36, the adhesive 54, and the horizontal beam 10. Looking closely at FIG. 6, the resilient fin 45 is folded over in an upward direction, having been folded toward the right angle top surface 48 of the resilient fin 46. The folding over of the resilient fin 46 as it compresses may be the combined result of the shape of the fin 46 and the upward movement of the electronic shelf label 24 as lower angled catch projections 80 move up and over the lower gripping flange 32 when the electronic shelf label 24 is moved into an engaged position in the elongated channel 28.

Figure 7:
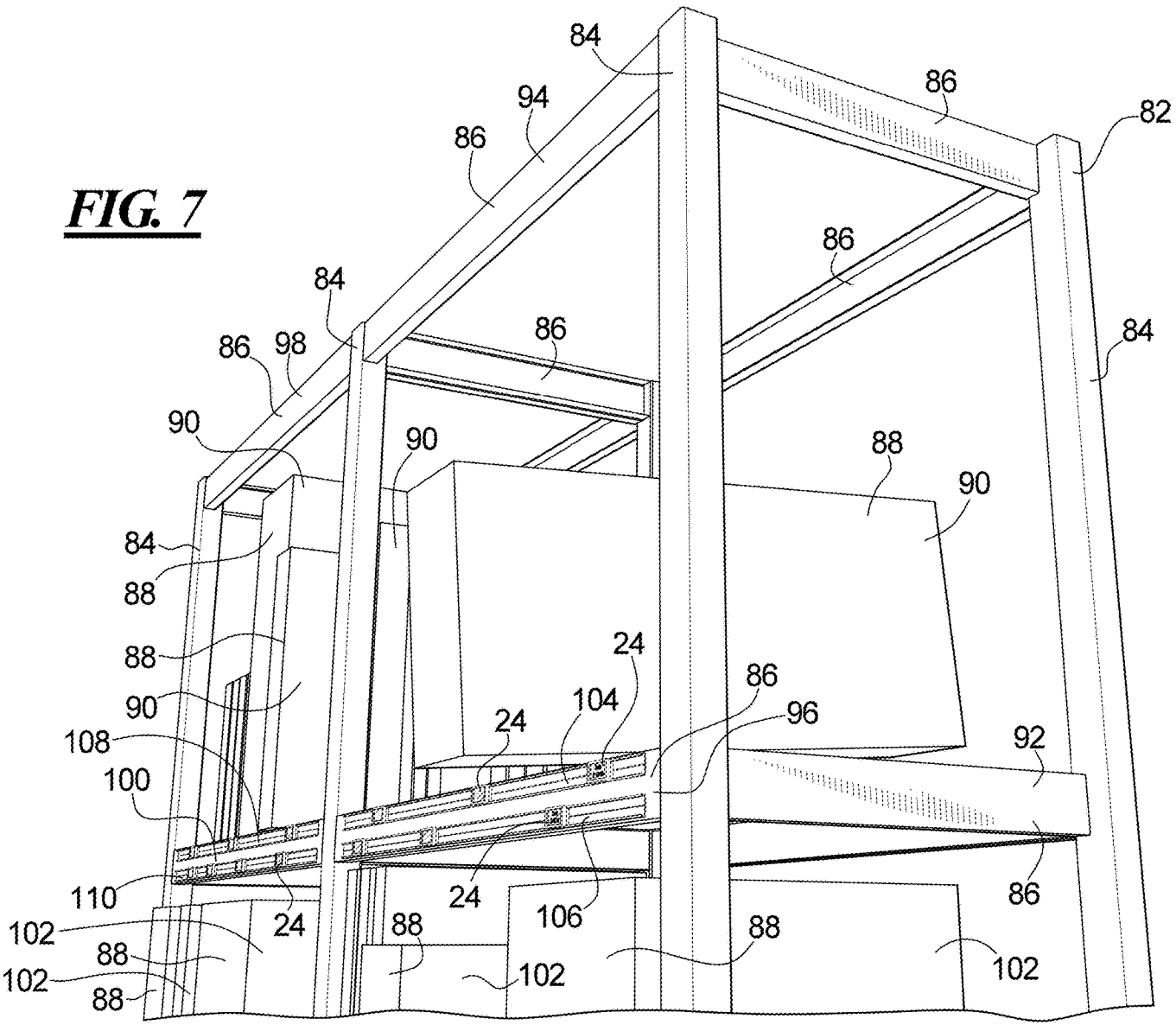
FIG. 7 is an environmental view showing a shelf system on which products are stored and showing multiple shelf label holders on the shelf system.
Figure 8:
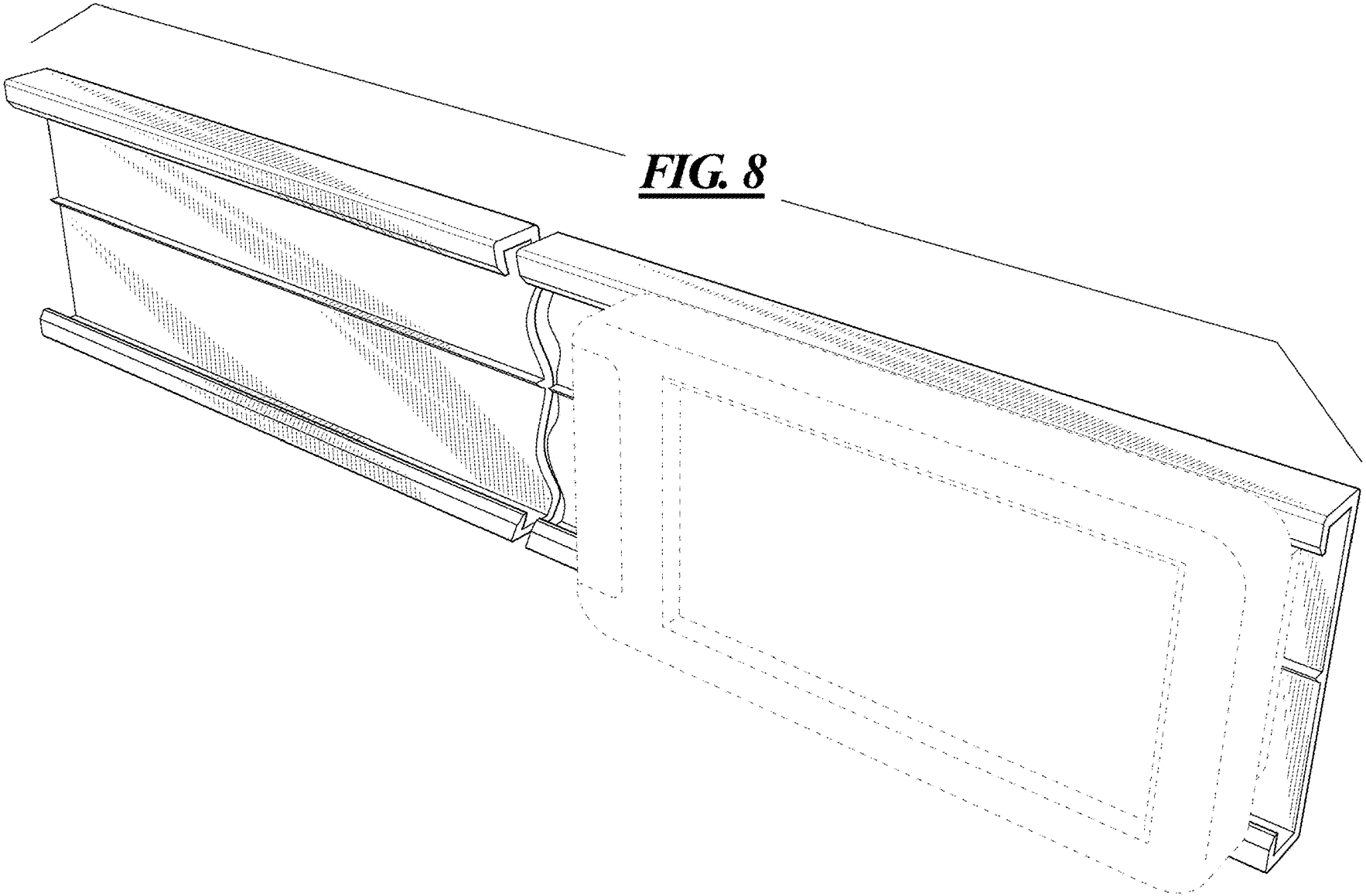
Figure 9:
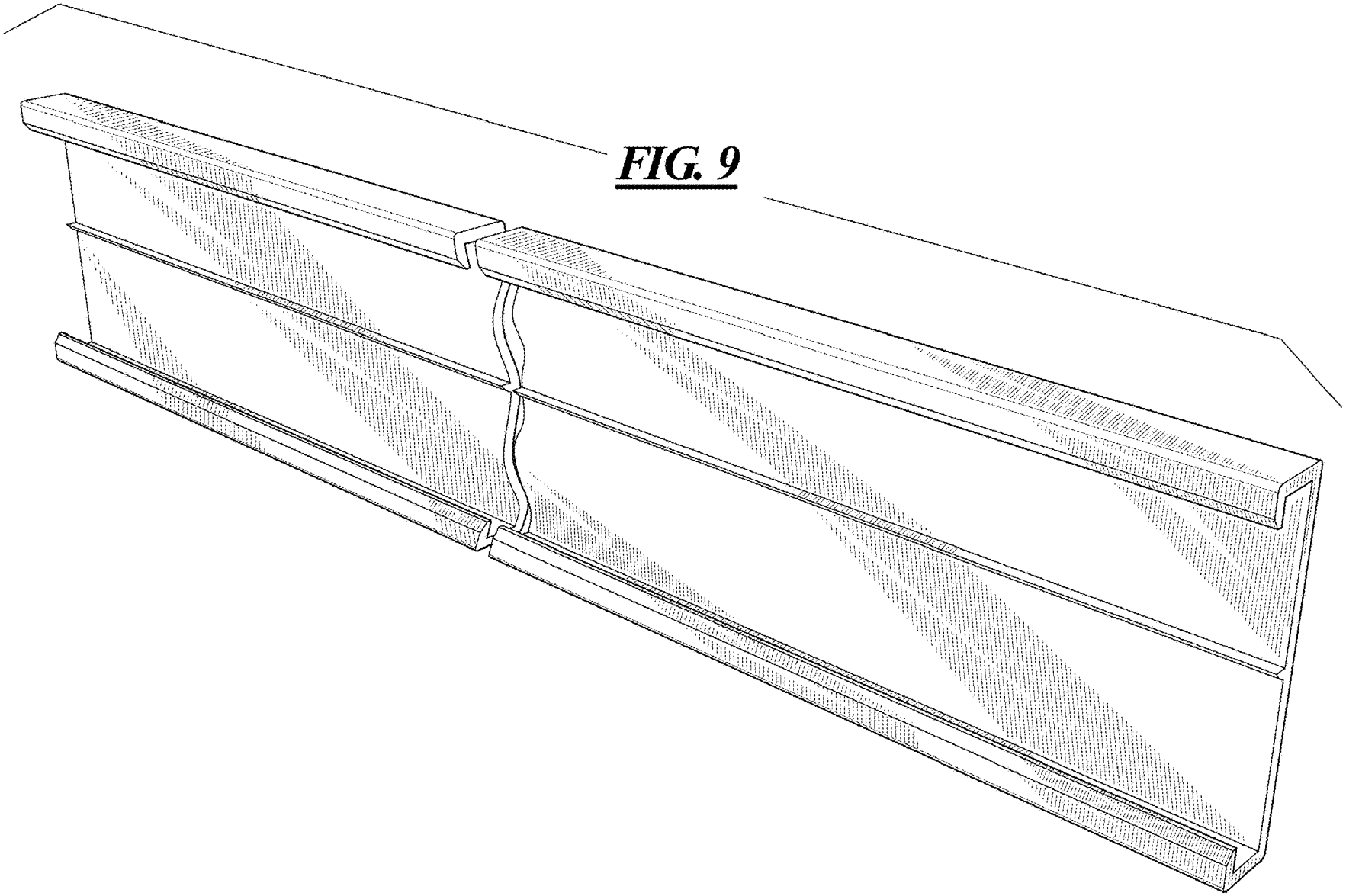
Figure 12:
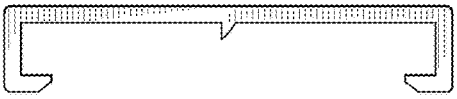
Figure 13:
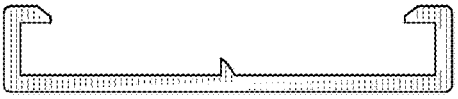
Figure 10:
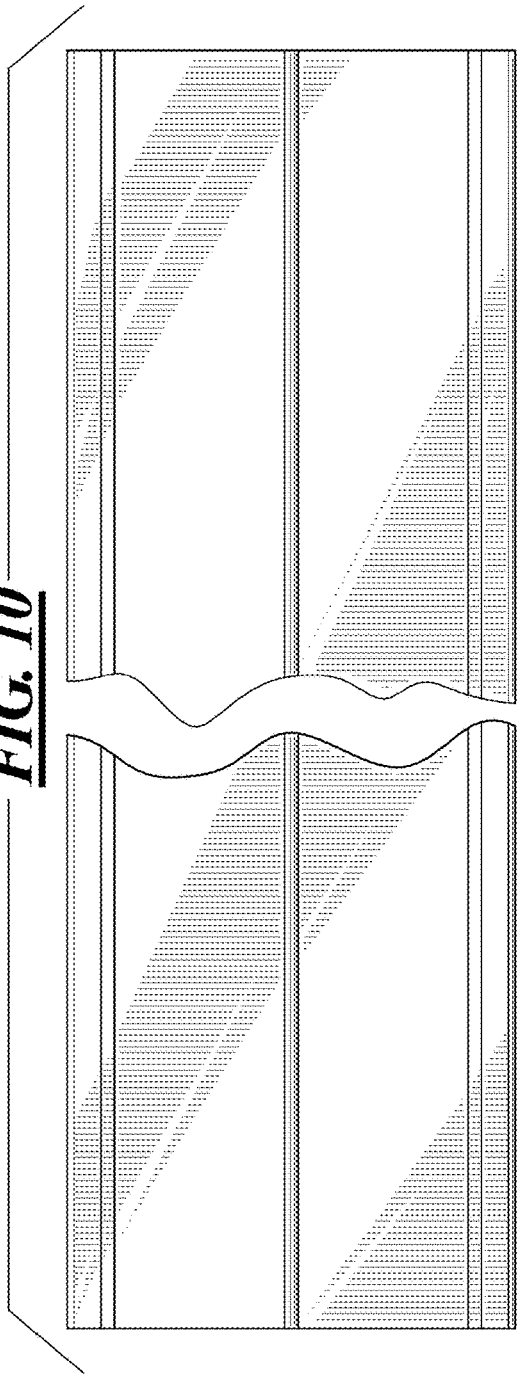
Figure 11:
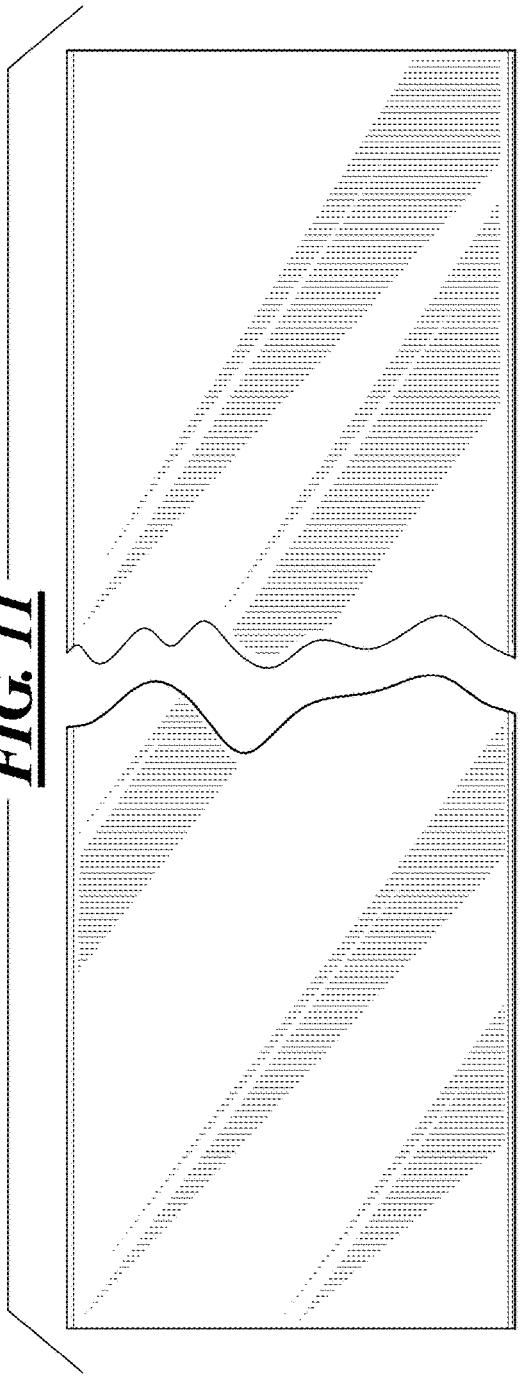
Figure 14:
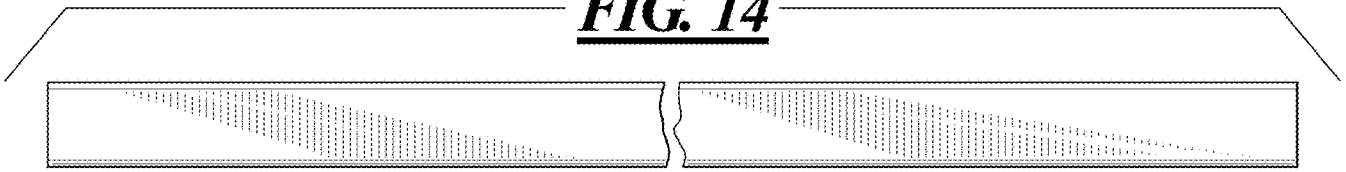
Figure 15:
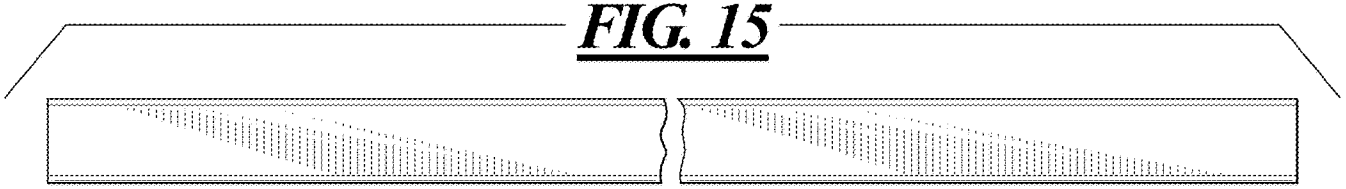

Advancing to FIG. 7, a shelf unit 82 in a store, such as in a home store, big box store, warehouse store, appliance store, or other facility, has vertical beams 84 connected to horizontal beams 86 to form a framework within which is provided shelves that support merchandise 88. The merchandise 88 may include large items such as appliances, building materials, furniture or other items for selection by a customer, or may be smaller items. In the illustration, top shelf merchandise 90 is stored on an upper shelf 92 of a first shelf portion 94. A horizontal beam 96 extends along the front of the first shelf portion 94. Top shelf merchandise 90 is also stored on the upper shelf 92 of a second shelf portion 98. A horizontal beam 100 extends along the front of the second shelf portion 98. Lower shelf merchandise 102 is stored on lower shelves (not shown) of the first and second shelf portions 94 and 98.

In this installation of the shelf label holder 22, a first elongated channel 104 is mounted near the top of the horizontal beam 96 and a second elongated channel 106 is mounted near the bottom of the horizontal beam 96. The first elongated channel 104 holds the electronic shelf labels 24 for the top shelf merchandise 90 in the first shelf portion 94 and the second elongated channel 106 holds the electronic shelf labels 24 for the lower shelf merchandise 102 of the first shelf portion 94. The elongated channels 104 and 106 have been mounted using the breakaway guide 56 on the respective upper and lower surface of the beam 96. As a result of the breakaway guide 56, the elongated channels are uniformly positioned in parallel with one another over the entire length of the channels.

On the horizontal beam 100 of the second shelf portion 98 is a third elongated channel 108 near the top of the beam 100 and a fourth elongated channel 110 near the bottom of the beam 100. The first horizontal beam 96 and the second horizontal beam 100 are axially aligned with one another. The third elongated channel 108 on the second horizontal beam 100 is aligned with the first elongated channel 104 on the first horizontal beam 96 as a result of both being mounted using the breakaway guide 56. The fourth elongated channel 110 on the second horizontal beam 100 is aligned with the second elongated channel 106 on the first horizontal beam 96 as a result of the breakaway guide 56. The alignment of the elongated channels 104, 106, 108 and 110 from shelf to shelf provides a neat and appealing visual appearance as customers and others look down a store aisle.

The elongated channels 104, 106, 108 and 110 are spaced from the top and bottom surfaces of the horizontal beams 96 and 100 by the use of the breakaway guides so that the elongated channels and the electronic shelf labels 24 mounted in the channels are not bumped as customers remove merchandise 88 from the shelves or when stocking the merchandise onto the shelves. In the illustration, a top shelf merchandise item 90 is being removed from the upper shelf 92. The merchandise item 90 clears the elongated channel 104 and the electronic shelf labels 24 mounted in the elongated channel 104. The electronic shelf labels 24 are not dislodged or displaced. Similarly, the electronic shelf labels 24 in the lower elongated channel 106 are not dislodged or displaced by customers removing lower shelf merchandise items 102 from the shelf below the horizontal beam 96 or by stocking of the lower shelf with merchandise 102 by store employees.

Various aspects of the apparatus and method are provided as follows.

In a first aspect, a holder for an electronic shelf label, comprises: a backplane including a planar body having a planar front surface; a lower ledge extending from the backplane at a right angle to the planar front surface, the lower ledge being elongated in an extrusion direction; an upper ledge extending from the backplane at a right angle to the planar front surface, the upper ledge being elongated in the extrusion direction, the upper ledge being spaced from the lower ledge; a lower gripping flange extending at a right angle from a free edge of the lower ledge, the lower gripping flange extending toward the upper ledge, the lower gripping flange being elongated in the extrusion direction; an upper gripping flange extending at right angle from a free edge of the upper ledge, the upper gripping flange extending toward the lower ledge, the upper gripping flange being elongated in the extrusion direction; the backplane and the lower ledge and the upper ledge and the lower gripping flange and the upper gripping flange defining an engagement space configured for engaging a rear portion of the electronic shelf label; a lower bevel at a free edge of the lower gripping flange, the lower bevel facing away from the backplane, the lower bevel extending along a full length of the lower gripping flange; an upper bevel at a free edge of the upper gripping flange, the upper bevel facing away from the backplane, the upper bevel extending along a full length of the upper gripping flange; a fin extending from the planar front surface of the backplane, the fin being elongated in the extrusion direction, the fin being triangular in cross section transverse to the extrusion direction, the fin having a side of the triangular cross section expending perpendicular to the planar front surface of the backplane, the fin being formed of a high friction material; and the fin and the backplane and the lower and upper ledges and the lower and upper gripping flanges being formed in one piece by co-extrusion of the backplane and the lower and upper ledges and the lower and upper gripping flanges of a first material and the fin of a second material.

In a second aspect, the holder of the first aspect, wherein the lower ledge and the lower gripping flange are symmetrical to the upper ledge and the upper gripping flange.

In a third aspect, the holder of the first aspect, wherein the fin is configured for folding in a direction toward the side extending perpendicular to the planar front surface of the backplane.

In a fourth aspect, the holder of the first aspect, wherein the fin is midway between the lower ledge and the upper ledge.

In a fifth aspect, the holder of the first aspect, wherein the side of the fin extending perpendicular to the planar front surface of the backplane is directed toward the upper ledge In a sixth aspect, the holder of the first aspect, further comprising: a breakaway guide affixed to the backplane by a thinned portion, the thinned portion being configured for releasing the breakaway guide from the backplane upon application of a tearing force.

In a seventh aspect, the holder of the sixth aspect, wherein the breakaway guide is L-shaped in cross section with a first portion of the L shape parallel to the backplane and a second portion extending perpendicular to the backplane in a direction opposite the upper ledge.

In an eighth aspect, the holder of the sixth aspect, wherein the breakaway guide is co-extruded with the backplane.

In a ninth aspect, the holder of the eighth aspect, wherein the breakaway guide is formed of a material of the first color and the backplane is formed of a material of a second color.

In a tenth aspect, the holder of the sixth aspect, wherein the breakaway guide extends from the upper ledge and wherein the fin has a side perpendicular to the planar body of the backplane that faces the upper ledge.

In an eleventh aspect, the holder of the sixth aspect, further comprising: a triangular-shaped projection extending from the upper ledge in a plane of the backplane, the triangular projection having a length extending in the extrusion direction, the triangular projection having an apex corner projecting to which the thinned portion is connected prior to removal of the breakaway guide.

In a twelfth aspect, the holder of the first aspect, wherein the backplane has a planar back surface, and further comprising: an adhesive on the planar backplane, the adhesive being configured for adhesion to a mounting surface for the holder.

In a thirteenth aspect, the holder of the twelfth aspect, wherein the adhesive includes foam tape affixed to the planar back surface of the backplane, the foam tape having a long dimension extending in the extrusion direction, foam tape being provided with a pealable cover prior to installation on the mounting surface.

In a fourteenth aspect, a label holder, comprising: a channel configured for holding a label; a breakaway guide configured for engaging an edge of a structure to which the label holder is be mounted during mounting of the channel onto the structure; and a thinned portion connecting the channel to the breakaway guide, the thinned portion being configured to be torn when separating the breakaway guide from the channel.

In a fifteenth aspect, the label holder of the fourteenth aspect, wherein the channel is configured for holding an electronic shelf label.

In a sixteenth aspect, the label holder of the fifteenth aspect, wherein the channel include a backplane, an upper ledge extending from the backplane, an upper gripping flange extending from a free end of the upper ledge, a lower ledge extending from the backplane at a location spaced from the upper ledge, a lower gripping flange extending from a free end of the lower ledge, the backplane and upper and lower ledges and upper and lower gripping flanges defining an engagement space configured for receiving a back portion of an electronic shelf label.

In a seventeenth aspect, the label holder of the sixteenth aspect, further comprising: a fin extending from the backplane into the engagement space, the fin having a triangular shape in cross section.

In an eighteenth aspect, the label holder of the seventeenth aspect, wherein the fin has a first side extending perpendicular to the backplane.

In a nineteenth aspect, the label holder of the seventeenth aspect, wherein the fin extends from the backplane by a distance that is 30 percent of the distance that the upper ledge extends from the backplane.

In a twentieth aspect, the label holder of the seventeenth aspect, wherein the channel and the breakaway guide and the fin are formed by co-extrusion, the channel being formed of a first material and the fin being formed of a second material, the second material being a pliable, high friction material.

In a twenty-first aspect, the label holder of the seventeenth aspect, wherein the fin is midway between the upper ledge and the lower ledge.

In a twenty-second aspect, a holder for an electronic shelf label, comprises: a backplane including a planar body having a planar front surface; a lower ledge extending from the backplane at a right angle to the planar front surface, the lower ledge being elongated in an extrusion direction; an upper ledge extending from the backplane at a right angle to the planar front surface, the upper ledge being elongated in the extrusion direction, the upper ledge being spaced from the lower ledge; a lower gripping flange extending at a right angle from a free edge of the lower ledge, the lower gripping flange extending toward the upper ledge, the lower gripping flange being elongated in the extrusion direction; an upper gripping flange extending at right angle from a free edge of the upper ledge, the upper gripping flange extending toward the lower ledge, the upper gripping flange being elongated in the extrusion direction; the backplane and the lower ledge and the upper ledge and the lower gripping flange and the upper gripping flange defining an engagement space configured for engaging a rear portion of the electronic shelf label; a lower bevel at a free edge of the lower gripping flange, the lower bevel facing away from the backplane, the lower bevel extending along a full length of the lower gripping flange; a fin extending from the planar front surface of the backplane, the fin being elongated in the extrusion direction, the fin being triangular in cross section transverse to the extrusion direction, the fin having a side of the triangular cross section expending perpendicular to the planar front surface of the backplane, the fin being formed of a high friction material, the fin being configured for folding toward the side extending perpendicular to the planar front surface of the backplane, the fin being midway between the upper and lower ledges; and the fin and the backplane and the lower and upper ledges and the lower and upper gripping flanges being formed in one piece by co-extrusion of the backplane and the lower and upper ledges and the lower and upper gripping flanges of a first material and the fin of a second material.

In a twenty-third aspect, the holder of the twenty-second aspect, wherein the backplane has a planar back surface, and further comprising: an adhesive tape affixed to the planar back surface of the backplane.

In a twenty-fourth aspect, the holder of the twenty-third aspect, wherein the adhesive tape is affixed onto the backplane behind the fin.

In a twenty-fifth aspect, the holder of the twenty-second aspect, further comprising: a breakaway guide extending from the backplane, the breakaway guide being configured in a receiving shape to receive an edge of a structure to which the holder is to be mounted while positioning the backplane spaced by a predetermined distance from the edge of the structure, the breakaway guide being affixed to the backplane by a releasable connection.

In a twenty-sixth aspect, the holder of the twenty-fifth aspect, wherein the releasable connection include a thin web extending between the breakaway guide and the backplane.

In a twenty-seventh aspect, a method for mounting a label holder onto a structure, comprises: positioning an L-shaped breakaway guide on an edge of a structure to which the label holder is to be mounted, the label holder extending onto a surface of the structure onto which the label holder is to be mounted; affixing the label holder to the surface of the structure while the L-shaped breakaway guide maintained at the edge of the structure; and removing the L-shaped breakaway from the label holder.

In a twenty-eighth aspect, the method of the twenty-seventh aspect, wherein the removing step includes tearing a membrane connecting the L-shaped breakaway to the label holder.

In a twenty-ninth aspect, the method of the twenty-seventh aspect, wherein the affixing step includes adhering an adhesive tape on the back of the label holder to the surface of the structure.

In a thirtieth aspect, the method of the twenty-seventh aspect, further comprising: mounting an electronic shelf label into the label holder.

In a thirty-first aspect, the method of the thirtieth aspect, wherein the mounting step includes: positioning a first extension of the electronic shelf label into a space defined by a backplane and a first ledge and a first gripping flange of the label holder; compressing a pliable fin extending from the backplane of the label holder between the electronic shelf label and the backplane of the label holder; and engaging a second ledge and second gripping flange of the label holder onto an angled catch projection of the electronic shelf label.

In a thirty-second aspect, a method for mounting an electronic label holder in a label holder, comprises: positioning a first extension of the electronic shelf label into a space defined by a backplane and a first ledge and a first gripping flange of the label holder; pivoting the electronic shelf label toward the backplane of the label holder; compressing a pliable fin extending from the backplane of the label holder between the electronic shelf label and the backplane of the label holder, the compressing including folding the pliable fin toward a side of the pliable fin extending perpendicular to the backplane and away from a side of the pliable fin extending at an acute angle to the backplane; and engaging a second ledge and second gripping flange of the label holder onto an angled catch projection of the electronic shelf label so that the angled catch projection is within a space defined by the backplane and the second ledge and the second gripping flange.

In a thirty-third aspect, the method of the thirty-second aspect, wherein the positioning step is preceded by: aligning the label holder on a mounting surface using a breakaway guide extending from the label holder; and mounting the label holder to the mounting surface.

In a thirty-fourth aspect, the method of the thirty-third aspect, further comprising: removing the breakaway guide from the label holder following mounting the label holder to the mounting surface.

Thus, there is shown and described a holder for electronic shelf labels includes a channel having upper and lower ledges with upper and lower gripping flanges defining an engagement space into which a back of the electronic shelf label is mounted. A fin extends from a backplane of the channel, the fin having one side perpendicular to the backplane. The front of the upper and lower gripping flanges have inwardly-directed bevels. A breakaway guide is connected by a thinned portion to the backplane to engaging an edge of a mounting structure. The breakaway guide is removable following mounting of the channel.

Although other modifications and changes may be suggested by those skilled in the art, it is the intention of the inventors to embody within the patent warranted hereon all changes and modifications as reasonably and properly come within the scope of their contribution to the art.

We claim:

1. A holder for an electronic shelf label, comprising:

a backplane including a planar body having a planar front surface;

a lower ledge extending from the backplane at a right angle to the planar front surface, the lower ledge being elongated in an extrusion direction;

an upper ledge extending from the backplane at a right angle to the planar front surface, the upper ledge being elongated in the extrusion direction, the upper ledge being spaced from the lower ledge;

a lower gripping flange extending at a right angle from a free edge of the lower ledge, the lower gripping flange extending toward the upper ledge, the lower gripping flange being elongated in the extrusion direction;

an upper gripping flange extending at right angle from a free edge of the upper ledge, the upper gripping flange extending toward the lower ledge, the upper gripping flange being elongated in the extrusion direction;

the backplane and the lower ledge and the upper ledge and the lower gripping flange and the upper gripping flange defining an engagement space configured for engaging a rear portion of the electronic shelf label;

a lower bevel at a free edge of the lower gripping flange, the lower bevel facing away from the backplane, the lower bevel extending along a full length of the lower gripping flange, a planar outer surface of the lower gripping flange parallel to the backplane being disposed below the lower bevel;

an upper bevel at a free edge of the upper gripping flange, the upper bevel facing away from the backplane, the upper bevel extending along a full length of the upper gripping flange, a planar outer surface of the upper gripping flange parallel to the backplane being disposed above the upper bevel;

a fin extending from the planar front surface of the backplane, the fin being elongated in the extrusion direction, the fin being triangular in cross section transverse to the extrusion direction, the fin having a first side of the triangular cross section expending perpendicular to the planar front surface of the backplane, the fin having a second side of the triangular cross section shaped as a convex curve, the fin being formed of a high friction material; and the fin and the backplane and the lower and upper ledges and the lower and upper gripping flanges being formed in one piece by co-extrusion of the backplane and the lower and upper ledges and the lower and upper gripping flanges of a first material and the fin of a second material.

2. The holder as claimed in claim 1, wherein the lower ledge and the lower gripping flange are symmetrical to the upper ledge and the upper gripping flange.

3. The holder as claimed in claim 1, wherein the fin is configured for folding in a direction toward the side extending perpendicular to the planar front surface of the backplane.

4. The holder as claimed in claim 1, wherein the fin is midway between the lower ledge and the upper ledge.

5. The holder as claimed in claim 1, wherein the side of the fin extending perpendicular to the planar front surface of the backplane is directed toward the upper ledge.

6. The holder as claimed in claim 1, wherein the backplane has a planar back surface, and further comprising:

an adhesive on the planar backplane, the adhesive being configured for adhesion to a mounting surface for the holder.

7. The holder as claimed in claim 6, wherein the adhesive includes foam tape affixed to the planar back surface of the backplane, the foam tape having a long dimension extending in the extrusion direction, foam tape being provided with a pealable cover prior to installation on the mounting surface.

8. A holder for an electronic shelf label, comprising:

a backplane including a planar body having a planar front surface;

a lower ledge extending from the backplane at a right angle to the planar front surface, the lower ledge being elongated in an extrusion direction;

an upper ledge extending from the backplane at a right angle to the planar front surface, the upper ledge being elongated in the extrusion direction, the upper ledge being spaced from the lower ledge;

a lower gripping flange extending at a right angle from a free edge of the lower ledge, the lower gripping flange extending toward the upper ledge, the lower gripping flange being elongated in the extrusion direction;

an upper gripping flange extending at right angle from a free edge of the upper ledge, the upper gripping flange extending toward the lower ledge, the upper gripping flange being elongated in the extrusion direction;

the backplane and the lower ledge and the upper ledge and the lower gripping flange and the upper gripping flange defining an engagement space configured for engaging a rear portion of the electronic shelf label;

a lower bevel at a free edge of the lower gripping flange, the lower bevel facing away from the backplane, the lower bevel extending along a full length of the lower gripping flange;

an upper bevel at a free edge of the upper gripping flange, the upper bevel facing away from the backplane, the upper bevel extending along a full length of the upper gripping flange;

a fin extending from the planar front surface of the backplane, the fin being elongated in the extrusion direction, the fin being triangular in cross section transverse to the extrusion direction, the fin having a side of the triangular cross section expending perpendicular to the planar front surface of the backplane, the fin being formed of a high friction material;

the fin and the backplane and the lower and upper ledges and the lower and upper gripping flanges being formed in one piece by co-extrusion of the backplane and the lower and upper ledges and the lower and upper gripping flanges of a first material and the fin of a second material; and a breakaway guide affixed to the backplane by a thinned portion, the thinned portion being configured for releasing the breakaway guide from the backplane upon application of a tearing force, the breakaway guide being configured for removal from the backplane following mounting of the holder at a mounting location and while the holder is mounted at the mounting location, the breakaway guide playing no role in holding the holder at the mounting location both before removal of the breakaway guide from the backplane and after removal of the breakaway guide from the backplane, the holder being maintained in a mounted condition at the mounting location free of the breakaway guide.

9. The holder as claimed in claim 8, wherein the breakaway guide is L-shaped in cross section with a first portion of the L shape parallel to the backplane and a second portion extending perpendicular to the backplane in a direction opposite the upper ledge.

10. The holder as claimed in claim 8, wherein the breakaway guide is co-extruded with the backplane.

11. The holder as claimed in claim 10, wherein the breakaway guide is formed of a material of a first color and the backplane is formed of a material of a second color to indicate to a user to remove the breakaway guide after mounting the holder at the mounting location.

12. The holder as claimed in 8, wherein the breakaway guide extends from the upper ledge and wherein the fin has a side perpendicular to the planar body of the backplane that faces the upper ledge.

13. The holder as claimed in claim 8, further comprising:

a triangular-shaped projection extending from the upper ledge in a plane of the backplane, the triangular projection having a length extending in the extrusion direction, the triangular projection having an apex corner projecting to which the thinned portion is connected prior to removal of the breakaway guide.

14. A label holder, comprising:

a channel configured for holding a label, the channel having a backplane;

a breakaway guide configured for engaging an edge of a structure to which the label holder is be mounted during mounting of the channel onto the structure, the breakaway guide having a first portion coplanar with the backplane of the channel and a second portion at a right angle to the first portion, the second portion including an alignment surface configured to lie flush on a surface of the structure to align the label holder relative to the surface of the structure, the alignment surface being free of projections; and a thinned portion connecting the channel to the breakaway guide, the thinned portion being configured to be torn when separating the breakaway guide from the channel;

wherein the channel is configured to be mounted at a mounting location free of the breakaway guide.

15. The label holder as claimed in claim 14, wherein the channel is configured for holding an electronic shelf label.

16. The label holder as claimed in claim 15, wherein the channel include a backplane, an upper ledge extending from the backplane, an upper gripping flange extending from a free end of the upper ledge, a lower ledge extending from the backplane at a location spaced from the upper ledge, a lower gripping flange extending from a free end of the lower ledge, the backplane and upper and lower ledges and upper and lower gripping flanges defining an engagement space configured for receiving a back portion of an electronic shelf label.

17. The label holder as claimed in claim 16, further comprising:

a fin extending from the backplane into the engagement space, the fin having a triangular shape in cross section.

18. The label holder as claimed in claim 17, wherein the fin has a first side extending perpendicular to the backplane.

19. The label holder as claimed in claim 17, wherein the fin extends from the backplane by a distance that is 30 percent of the distance that the upper ledge extends from the backplane.

20. The label holder as claimed in claim 17, wherein the channel and the breakaway guide and the fin are formed by co-extrusion, the channel being formed of a first material and the fin being formed of a second material, the second material being a pliable, high friction material.

21. The label holder as claimed in claim 17, wherein the fin is midway between the upper ledge and the lower ledge.

22. A holder for an electronic shelf label, comprising:

a backplane including a planar body having a planar front surface;

a lower ledge extending from the backplane at a right angle to the planar front surface, the lower ledge being elongated in an extrusion direction;

an upper ledge extending from the backplane at a right angle to the planar front surface, the upper ledge being elongated in the extrusion direction, the upper ledge being spaced from the lower ledge;

a lower gripping flange extending at a right angle from a free edge of the lower ledge, the lower gripping flange extending toward the upper ledge, the lower gripping flange being elongated in the extrusion direction;

an upper gripping flange extending at right angle from a free edge of the upper ledge, the upper gripping flange extending toward the lower ledge, the upper gripping flange being elongated in the extrusion direction;

the backplane and the lower ledge and the upper ledge and the lower gripping flange and the upper gripping flange defining an engagement space configured for engaging a rear portion of the electronic shelf label;

a lower bevel at a free edge of the lower gripping flange, the lower bevel facing away from the backplane, the lower bevel extending along a full length of the lower gripping flange, a planar outer surface of the lower gripping flange parallel to the backplane being disposed below the lower bevel;

a fin extending from the planar front surface of the backplane, the fin being elongated in the extrusion direction, the fin being triangular in cross section transverse to the extrusion direction, the fin having a first side of the triangular cross section expending perpendicular to the planar front surface of the backplane, the fin having a second side of the triangular cross section shaped in a convex curve, the fin being formed of a high friction material, the fin being configured for folding toward the side extending perpendicular to the planar front surface of the backplane, the fin being midway between the upper and lower ledges; and the fin and the backplane and the lower and upper ledges and the lower and upper gripping flanges being formed in one piece by co-extrusion of the backplane and the lower and upper ledges and the lower and upper gripping flanges of a first material and the fin of a second material.

23. The holder as claimed in claim 22, wherein the backplane has a planar back surface, and further comprising:

an adhesive tape affixed to the planar back surface of the backplane.

24. The holder as claimed in claim 23, wherein the adhesive tape is affixed onto the backplane behind the fin.

25. The holder as claimed in claim 22, further comprising:

a breakaway guide extending from the backplane, the breakaway guide being configured in a receiving shape to receive an edge of a structure to which the holder is to be mounted while positioning the backplane spaced by a predetermined distance from the edge of the structure, the breakaway guide being affixed to the backplane by a releasable connection, the breakaway guide being configured for removal of the breakaway guide from the holder while the holder remains attached to the structure.

26. The holder as claimed in 25, wherein the releasable connection include a thin web extending between the breakaway guide and the backplane.

27. A method for mounting a label holder onto a structure, comprising:

positioning an L-shaped breakaway guide on an edge of a structure to which the label holder is to be mounted, the label holder extending onto a surface of the structure onto which the label holder is to be mounted;

affixing the label holder to the surface of the structure while the L-shaped breakaway guide maintained at the edge of the structure; and removing the L-shaped breakaway from the label holder.

28. The method as claimed in claim 27, wherein the removing step includes tearing a membrane connecting the L-shaped breakaway to the label holder.

29. The method as claimed in claim 27, wherein the affixing step includes adhering an adhesive tape on the back of the label holder to the surface of the structure.

30. The method as claimed in claim 27, further comprising:

mounting an electronic shelf label into the label holder.

31. The method as claimed in claim 30, wherein the mounting step includes:

positioning a first extension of the electronic shelf label into a space defined by a backplane and a first ledge and a first gripping flange of the label holder;

compressing a pliable fin extending from the backplane of the label holder between the electronic shelf label and the backplane of the label holder; and engaging a second ledge and second gripping flange of the label holder onto an angled catch projection of the electronic shelf label.

32. A method for mounting an electronic label holder in a label holder, comprising:

positioning a first extension of the electronic shelf label into a space defined by a backplane and a first ledge and a first gripping flange of the label holder;

pivoting the electronic shelf label toward the backplane of the label holder;

compressing a pliable fin extending from the backplane of the label holder between the electronic shelf label and the backplane of the label holder, the compressing including folding the pliable fin toward a side of the pliable fin extending perpendicular to the backplane and away from a side of the pliable fin extending at an acute angle to the backplane; and engaging a second ledge and second gripping flange of the label holder onto an angled catch projection of the electronic shelf label so that the angled catch projection is within a space defined by the backplane and the second ledge and the second gripping flange;

wherein the positioning step is preceded by:

aligning the label holder on a mounting surface using a breakaway guide extending from the label holder; and mounting the label holder to the mounting surface.

33. The method as claimed in claim 32, further comprising:

removing the breakaway guide from the label holder following mounting the label holder to the mounting surface.

* * * * *